US008546316B2

(12) United States Patent
Perez-Prat Vinuesa et al.

(10) Patent No.: US 8,546,316 B2
(45) Date of Patent: Oct. 1, 2013

(54) LIQUID DETERGENT COMPOSITION WITH NATURAL ABRASIVE PARTICLES

(75) Inventors: Eva Maria Perez-Prat Vinuesa, Brussels (BE); Denis Alfred Gonzales, Brussels (BE); Anna Asmanidou, Brussels (BE); Susana Fernandez Prieto, Benicarlo (ES)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/236,682

(22) Filed: Sep. 20, 2011

(65) Prior Publication Data

US 2012/0071383 A1 Mar. 22, 2012

(30) Foreign Application Priority Data

Sep. 21, 2010 (EP) ..... 10 177 814
Sep. 21, 2010 (EP) ..... 10 177 815
Jun. 20, 2011 (EP) ..... 11 170 553

(51) Int. Cl.
*C11D 3/14* (2006.01)
*C11D 3/37* (2006.01)

(52) U.S. Cl.
USPC ..... 510/236; 510/235; 510/268; 510/368; 510/416; 510/418; 510/462; 510/473; 510/504

(58) Field of Classification Search
USPC ..... 510/235, 236, 268, 368, 416, 418, 510/462, 473, 504
See application file for complete search history.

(56) References Cited

U.S. PATENT DOCUMENTS

| | | | |
|---|---|---|---|
| 1,621,906 | A | 3/1927 | Schless |
| 2,082,275 | A | 6/1937 | Daimler et al. |
| 2,084,632 | A | 6/1937 | Ellis |
| 2,255,082 | A | 9/1941 | Orthner et al. |
| 2,438,091 | A | 3/1948 | Lynch |
| 2,528,378 | A | 10/1950 | Mannheimer |
| 2,658,072 | A | 11/1953 | Kosmin |
| 2,702,279 | A | 2/1955 | Funderburk et al. |
| 3,070,510 | A | 12/1962 | Cooley et al. |
| 3,586,715 | A | 6/1971 | Smeets |
| 3,812,044 | A | 5/1974 | Connor et al. |
| 3,915,903 | A | 10/1975 | Wise |
| 3,929,678 | A | 12/1975 | Laughlin et al. |
| 3,985,668 | A | 10/1976 | Hartman |
| 4,025,444 | A | 5/1977 | Murphy et al. |
| 4,051,056 | A | 9/1977 | Hartman |
| 4,088,620 | A | 5/1978 | Nihongi et al. |
| 4,102,992 | A | 7/1978 | Davis |
| 4,240,919 | A | 12/1980 | Chapman |
| 4,298,490 | A | 11/1981 | Lange et al. |
| 4,309,316 | A | 1/1982 | Lange et al. |
| 4,473,611 | A | 9/1984 | Haq |
| 4,481,126 | A | 11/1984 | Trinh et al. |
| 4,537,604 | A | 8/1985 | Dawson |
| 4,565,644 | A | 1/1986 | Smith et al. |
| 4,565,647 | A | 1/1986 | Llenado |
| 4,581,385 | A | 4/1986 | Smith et al. |
| 4,657,692 | A | 4/1987 | Choy et al. |
| 4,663,069 | A | 5/1987 | Llenado |
| 4,676,920 | A | 6/1987 | Culshaw |
| 4,704,233 | A | 11/1987 | Hartman et al. |
| 4,767,563 | A | 8/1988 | De Buzzaccarini |
| 4,772,425 | A | 9/1988 | Chirash et al. |
| 4,842,763 | A | 6/1989 | Troger et al. |
| 4,906,396 | A | 3/1990 | Falholt et al. |
| 5,287,207 | A | 2/1994 | Mulkens et al. |
| 5,500,451 | A | 3/1996 | Goldman et al. |
| 5,776,872 | A | 7/1998 | Giret et al. |
| 5,776,878 | A | 7/1998 | Thoen |
| 5,798,505 | A | 8/1998 | Lee |
| 5,821,214 | A | 10/1998 | Weibel |
| 5,830,445 | A | 11/1998 | Bouillon et al. |
| 5,883,062 | A | 3/1999 | Addison et al. |
| 5,898,026 | A | 4/1999 | Yianakopoulos et al. |
| 5,906,973 | A | 5/1999 | Ouzounis et al. |
| 6,008,181 | A | 12/1999 | Cripe et al. |
| 6,020,303 | A | 2/2000 | Cripe et al. |
| 6,060,443 | A | 5/2000 | Cripe et al. |
| 6,080,707 | A | 6/2000 | Glenn et al. |
| 6,132,212 | A | 10/2000 | Horiguchi et al. |
| 6,221,829 | B1 | 4/2001 | Symes et al. |
| 6,242,405 | B1 | 6/2001 | Lykke et al. |
| 2,305,434 | A1 | 7/2001 | Luciani et al. |
| 6,265,363 | B1 | 7/2001 | Viscovitz |
| 6,274,540 | B1 | 8/2001 | Scheibel et al. |

(Continued)

FOREIGN PATENT DOCUMENTS

| | | | |
|---|---|---|---|
| DE | 24 10 425 | A1 | 10/1974 |
| DE | 10 2004 038771 | A1 | 8/2005 |

(Continued)

OTHER PUBLICATIONS

PCT International Search Report, mailed Jan. 30, 2012 (13 pages).
EP International Search Report, dated Jan. 30, 2012 (8 pages).
ASTM Designation: F1877-05 Jun. 10, 2009; Standard Practice for Characterization of Particles; 14 pages; chapter 11.3.6; Section 11.3.2.
International Standard; ISO 9276-6:2008(E) section 8.2; section 7; Representation of results of particle size analysis—Part 6: Descriptive and quantitative representation of particle shape and morphology.
"Vegetable Ivory", W.P. Armstrong, (http://waynesword.palomar.edu/pljan99.htm).

(Continued)

*Primary Examiner* — Charles Boyer
(74) *Attorney, Agent, or Firm* — John T. Dipre; Steven W. Miller

(57) ABSTRACT

The present invention relates to a dishwashing composition comprising abrasive particles and a suspending aid selected from the group consisting of crystalline wax structurants, micro-fibril-cellulose, amido-gellants, di-benzylidene polyol acetal derivatives, and mixtures thereof, and the process and use thereof.

19 Claims, 3 Drawing Sheets

(56) References Cited

U.S. PATENT DOCUMENTS

| | | | | |
|---|---|---|---|---|
| 6,299,746 | B1 | 10/2001 | Conte et al. | |
| 6,306,817 | B1 | 10/2001 | Kott et al. | |
| 6,359,031 | B1 | 3/2002 | Lykke et al. | |
| 6,369,121 | B1 | 4/2002 | Catalfamo et al. | |
| 6,444,716 | B1 | 9/2002 | Hird et al. | |
| 6,514,926 | B1 | 2/2003 | Kott et al. | |
| 6,525,233 | B1 | 2/2003 | Connor et al. | |
| 6,537,957 | B1 | 3/2003 | Cardola et al. | |
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,699,963 | B2 | 3/2004 | Noda et al. | |
| 6,749,066 | B2 | 6/2004 | Bergman | |
| 6,759,377 | B2 | 7/2004 | Hackenthal et al. | |
| 6,767,878 | B1 | 7/2004 | Paye et al. | |
| 6,808,759 | B1 | 10/2004 | Okumura et al. | |
| 6,858,216 | B2 | 2/2005 | Schulze zur Wiesche et al. | |
| 2,384,243 | A1 | 12/2007 | Cook et al. | |
| 7,393,820 | B2 | 7/2008 | Soldanski et al. | |
| 7,713,921 | B2 | 5/2010 | Boutique et al. | |
| 7,994,111 | B2 | 8/2011 | Caggioni et al. | |
| 2002/0137647 | A1 | 9/2002 | Hackenthal et al. | |
| 2002/0166832 | A1 | 11/2002 | Silud et al. | |
| 2002/0173243 | A1 | 11/2002 | Costas et al. | |
| 2003/0176633 | A1 | 9/2003 | Noda et al. | |
| 2003/0215417 | A1 | 11/2003 | Uchiyama et al. | |
| 2004/0216388 | A1 | 11/2004 | Mathur et al. | |
| 2004/0266645 | A1 | 12/2004 | Albrecht et al. | |
| 2005/0065056 | A1 | 3/2005 | Cook et al. | |
| 2005/0130873 | A1 | 6/2005 | Cheung et al. | |
| 2005/0170979 | A1 | 8/2005 | Massaro et al. | |
| 2005/0201965 | A1 | 9/2005 | Kuhlman et al. | |
| 2006/0011885 | A1 | 1/2006 | Christmas et al. | |
| 2006/0094635 | A1* | 5/2006 | Pereira | 510/470 |
| 2006/0177488 | A1 | 8/2006 | Caruso et al. | |
| 2007/0006391 | A1 | 1/2007 | Ghosh et al. | |
| 2007/0010415 | A1 | 1/2007 | Kinscherf et al. | |
| 2007/0041927 | A1* | 2/2007 | Blaeser et al. | 424/70.27 |
| 2007/0043147 | A1 | 2/2007 | Higgins et al. | |
| 2007/0135645 | A1 | 6/2007 | Ignatyev et al. | |
| 2007/0138671 | A1 | 6/2007 | Anastasiou et al. | |
| 2007/0167345 | A1 | 7/2007 | Soldanski et al. | |
| 2007/0191256 | A1 | 8/2007 | Fossum et al. | |
| 2007/0270730 | A1 | 11/2007 | Rische et al. | |
| 2008/0108714 | A1 | 5/2008 | Swazey et al. | |
| 2008/0139702 | A1 | 6/2008 | De Almeida et al. | |
| 2008/0149137 | A1 | 6/2008 | Steinbrenner et al. | |
| 2008/0248144 | A1 | 10/2008 | Guenter et al. | |
| 2009/0176935 | A1 | 7/2009 | Boeckh et al. | |
| 2009/0253816 | A1 | 10/2009 | Nascimento et al. | |
| 2009/0291306 | A1 | 11/2009 | Quadbeck-Seeger | |
| 2009/0325837 | A1* | 12/2009 | Mundschau et al. | 510/139 |
| 2010/0081604 | A1 | 4/2010 | Barger et al. | |
| 2010/0081605 | A1 | 4/2010 | Barger et al. | |
| 2010/0081606 | A1 | 4/2010 | Barger et al. | |
| 2010/0197553 | A1 | 8/2010 | Barnabas et al. | |
| 2011/0021398 | A1* | 1/2011 | Allef et al. | 510/138 |
| 2011/0039744 | A1* | 2/2011 | Heath et al. | 510/121 |
| 2011/0150787 | A1 | 6/2011 | Gonzales et al. | |
| 2011/0150788 | A1 | 6/2011 | Gonzales et al. | |
| 2011/0150949 | A1 | 6/2011 | Gonzales et al. | |
| 2011/0150950 | A1 | 6/2011 | Gonzales et al. | |
| 2011/0150951 | A1 | 6/2011 | Gonzales et al. | |
| 2011/0178196 | A1 | 7/2011 | Steinke et al. | |
| 2011/0189414 | A1 | 8/2011 | Whitehouse | |
| 2011/0262371 | A1 | 10/2011 | Deleersnyder et al. | |
| 2011/0262504 | A1 | 10/2011 | Deleersnyder et al. | |
| 2011/0287105 | A1 | 11/2011 | Gittleman | |
| 2012/0029519 | A1 | 2/2012 | Sengun et al. | |
| 2012/0066851 | A1 | 3/2012 | Gonzales et al. | |
| 2012/0071378 | A1 | 3/2012 | Gonzales et al. | |
| 2012/0071379 | A1 | 3/2012 | Gonzales et al. | |
| 2012/0071380 | A1 | 3/2012 | Gonzales et al. | |
| 2012/0071383 | A1 | 3/2012 | Perez-Prat Vinuesa et al. | |
| 2012/0202730 | A1 | 8/2012 | Allef et al. | |

FOREIGN PATENT DOCUMENTS

| | | | |
|---|---|---|---|
| DE | 10 2005 023801 | A1 | 11/2006 |
| EP | 1 136 063 | A2 | 9/2001 |
| EP | 1 460 125 | A1 | 9/2004 |
| GB | 2 001 099 | A | 1/1979 |
| GB | 2 126 999 | A | 4/1984 |
| GB | 2 145 729 | A | 4/1985 |
| JP | 59192526 | A | 10/1984 |
| JP | 10025239 | A | 1/1998 |
| JP | 2005 296822 | A | 10/2005 |
| JP | 2007 077311 | A | 3/2007 |
| JP | 2009 160717 | A | 7/2009 |
| WO | WO 91/14420 | A1 | 10/1991 |
| WO | WO-99/05084 | A1 | 2/1999 |
| WO | WO 99/05084 | A1 | 2/1999 |
| WO | WO-99/05242 | A1 | 2/1999 |
| WO | WO-99/05244 | A1 | 2/1999 |
| WO | WO-99/07656 | A2 | 2/1999 |
| WO | WO 99/52500 | A1 | 10/1999 |
| WO | WO 01/31110 | A1 | 5/2001 |
| WO | WO 02/38720 | A1 | 5/2002 |
| WO | WO 2004/071483 | A1 | 8/2004 |
| WO | WO 2008/109270 | A1 | 9/2008 |

OTHER PUBLICATIONS

"Phytelephas", Wikipedia.org (http://en.wikipedia.org/wiki/Phytelephas).

U.S. Appl. No. 13/517,837, filed Jun. 14, 2012, Gonzales, et al.

U.S. Appl. No. 13/517,728, filed Jun. 14, 2012, Gonzales, et al.

U.S. Appl. No. 13/526,592, filed Jun. 19, 2012, Gonzales, et al.

U.S. Appl. No. 13/526,596, filed Jun. 19, 2012, Gonzales, et al.

U.S. Appl. No. 13/517,746, filed Jun. 14, 2012, Gonzales, et al.

U.S. Appl. No. 13/526,605, filed Jun. 19, 2012, Gonzales, et al.

U.S. Appl. No. 13/526,613, filed Jun. 19, 2012, Gonzales, et al.

U.S. Appl. No. 13/517,762, filed Jun. 14, 2012, Perez-Prat Vinuesa, et al.

U.S. Appl. No. 13/621,858, filed Sep. 18, 2012, Gonzales, et al.

U.S. Appl. No. 13/621,860, filed Sep. 18, 2012, Perez-Prat Vinuesa, et al.

* cited by examiner

A = the surface area of the particle

A(0.8) = the surface area of the projection of all inscribed discs having diameter ranging from Dmax to 0.8xDmax

LIQUID DETERGENT COMPOSITION WITH NATURAL ABRASIVE PARTICLES

FIELD OF INVENTION

The present invention relates to a dishwashing composition comprising abrasive particles and a suspending aid selected from the group consisting of crystalline wax structurants, micro-fibril-cellulose, amido-gellants, di-benzylidene polyol acetal derivatives, and mixtures thereof.

BACKGROUND OF THE INVENTION

Scouring compositions such as particulate compositions or liquid (incl. gel, paste-type) compositions containing abrasive components are well known in the art. Such compositions are used for cleaning and/or cleansing a variety of surfaces; especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymeric beads like polypropylene, PVC, melamine, urea, polyacrylate and derivatives, and come in the form of liquid composition having a creamy consistency with the abrasive particles suspended therein.

The surface safety profile of such currently known scouring compositions is inadequate, alternatively, poor cleaning performance and/or poor exfoliation to provide the desire skin care benefit is shown for compositions with an adequate surface safety profile. Indeed, due to the presence of very hard abrasive particles, these compositions can damage, i.e., scratch, the surfaces onto which they have been applied, and irritate and/or damage the skin of the user, while with less hard material the level of cleaning performance and skin exfoliation is insufficient. Indeed, the hand dishwashing formulator needs to choose between good cleaning performance but featuring strong surface and skin damage, or compromising on the cleaning performance while featuring an acceptable surface safety and skin safety profile. Moreover, the hand dishwashing formulator needs to ensure achieving such cleaning whilst providing adequate product rheology, optimal product dissolution and sudsing profile, and mild skin exfoliation benefits.

There remains, therefore, a need to provide a liquid hand dishwashing composition suitable to clean a variety of dishware surfaces, wherein the composition provides good cleaning performance of stubborn, hard to remove soils, and mild skin exfoliation, whilst providing a good surface safety profile. Further desired composition characteristics include optimal product rheology, dissolution and suds profile.

SUMMARY OF THE INVENTION

In one aspect, the present invention relates to a liquid hand dishwashing composition comprising: one or more suspending aids selected from the group consisting of crystalline wax structurants, amido-gellants, micro fibril cellulose, di-benzylidene polyol acetal derivatives, and mixtures thereof; and natural abrasive particles selected from the group consisting of nut shell particles, particles derived from other plant sources, and mixtures thereof; wherein said natural abrasive particles are comprised at a level of greater than 2% by weight of the total composition.

In another aspect, the present invention relates to a process comprising the steps of: fragmenting a material selected from the group consisting of nut shells, other plant sources, and mixtures thereof, to generate abrasive particles; adding said abrasive particles to a composition; and adding one or more suspending aids selected from the group consisting of crystalline wax structurants, amido-gellants, micro fibril cellulose, di-benzylidene polyol acetal derivatives, and mixtures thereof, wherein said abrasive particles are added at a level of greater than 2% by weight of the composition.

DETAILED DESCRIPTION OF THE INVENTION

Figure 1:
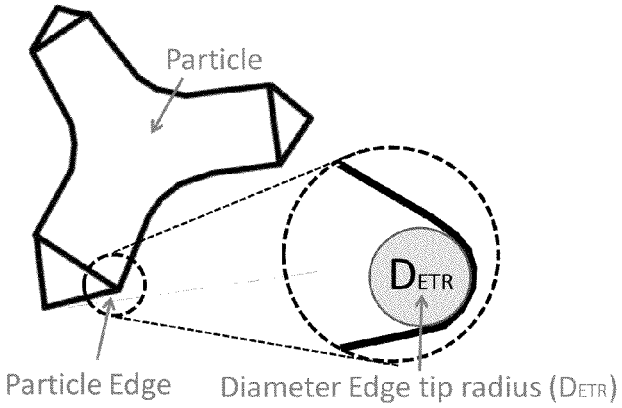
FIG. 1 is an illustration of tip radius.

As used herein "grease" means materials comprising at least in part (i.e., at least 0.5 wt % by weight of the grease) saturated and unsaturated fats and oils, preferably oils and fats derived from animal sources, such as beef and/or chicken; and/or vegetable sources.

As used herein "shelf stable" means a neat hand dishwashing liquid detergent composition that under ambient conditions does not phase separate for at least two weeks, preferably for at least six months, and more preferably never.

As used herein "dishware" refers to a hard surface such as dishes, glasses, pots, pans, baking dishes and flatware made from ceramic, chiria, metal, glass, plastic (polyethylene, polypropylene, polystyrene, etc.), wood, enamel, Inox®, Teflon®, or any other material commonly used in the making of articles used for eating and/or cooking.

As used herein "liquid dishwashing detergent composition" refers to those compositions that are employed in manual (i.e. hand) dishwashing. Such compositions are generally high sudsing or foaming in nature and are shelf stable.

As used herein "hand skin care benefit" means any benefit relating to hand skin appearance (such as smoothness, elasticity, absence of redness and absence of lines and wrinkles), skin feel (such as softness and suppleness), and skin moisture level.

As used herein "exfoliation or mild skin exfoliation" means removal of dead skin cells from the outermost layer of the skin whilst minimizing the risk of over-exfoliating the skin, which may otherwise result in damaged and red hands.

As used herein "suds profile" means amount of sudsing (high or low) and the persistence of sudsing (sustained or prevention) throughout the washing process resulting from the use of the liquid detergent composition of the present composition. Liquid dishwashing detergent compositions require high sudsing and sustained suds. This is particularly important with respect to liquid dishwashing detergent compositions as the consumer uses high sudsing as an indicator of the performance of the detergent composition and as an indicator that the wash solution still contains active detergent ingredients. The consumer usually renews the wash solution when the sudsing subsides. Thus, a low sudsing dishwashing liquid detergent composition will tend to be replaced by the consumer more frequently than is necessary because of the low sudsing level. As used herein "surface safety" means that the surface to be cleaned is not damaged by the composition of the present invention as seen by the lack of visual scratching on the dishware surface after cleaning.

As used herein "stubborn soil" means strongly adhering soils that are typically very difficult to remove. Such soils comprise but are not limited to burnt-on and/or baked-on food residues.

As used herein "polyurethane foam particles" means particles formed by shearing, grinding, milling, and/or graining polyurethane foam.

As used herein "polymeric material foam" means a polymeric structure having a lightweight cellular form resulting from the introduction of gas bubbles (or by other suitable means) during manufacture.

As used herein "polyurethane foam" means a polyurethane structure having a lightweight cellular form resulting from the introduction of gas bubbles (or by other suitable means) during manufacture.

As used herein "natural particles or natural abrasive particles" means particles derived from materials readily found in nature. Such particles are selected from the group consisting of nut shell particles; particles derived from other plant sources; and mixtures thereof.

Liquid Composition

The composition of the present invention is formulated as a liquid dishwashing detergent composition comprising abrasive particles and a suspending aid selected from the group consisting of crystalline wax structurants, micro-fibril-cellulose, amido-gellants, di-benzylidene polyol acetal derivatives, and mixtures thereof.

The liquid dishwashing compositions herein may further contain from 30% to 90% by weight of an aqueous liquid carrier in which the other essential and optional composition components are dissolved, dispersed or suspended. Preferably the aqueous liquid carrier will comprise from 45% to 80%, more preferably from 45% to 70% by weight of the compositions herein described. One preferred component of the aqueous liquid carrier is water. The aqueous liquid carrier, however, may contain other materials which are liquid, or which dissolve in the liquid carrier, at room temperature (20° C.-25° C.) and which may also serve some other function besides that of an inert filler. Such materials can include, for example, hydrotropes and solvents.

The liquid dishwashing composition may have any suitable pH. Preferably the pH of the composition is adjusted to between 4 and 14. Typically, the composition has pH of between 6 and 13, preferably between 7 and 10, more preferably between 7 and 9, and most preferably between 8 and 9. The pH of the composition can be adjusted using pH modifying ingredients known in the art.

Abrasive Particles

The compositions herein comprise natural abrasive particles, however may also further comprise other abrasive particles such as polymeric particles (herein also referred to as polymeric abrasive particles).

The abrasive particle size may be critical to achieve efficient cleaning performance whereas excessively abrasive population with small particle sizes e.g.: typically below 10 micrometers feature polishing action vs. cleaning despite featuring a high number of particles per particle load in cleaner inherent to the small particle size. On the other hand, abrasive population with excessively high particle size, e.g.: above 1000 micrometers, do not deliver optimal cleaning efficiency, because the number of particles per particle load in cleaner, decreases significantly inherently to the large particle size. Additionally, excessively small particle size are not desirable in cleaner/for cleaning task since in practice, small and numerous particles are often hard to remove from the various surface topologies which requires excessive effort by the user to remove, otherwise leaving the surface with visible particles residue. In addition, very small particles do not deliver the desired skin exfoliation experience as they are often not tactile detectable to the user and might increase the risk of over-exfoliating the skin as the user does not feel their action. However, excessively large particle are too easily detected visually or provide bad tactile experience while handling or using the cleaner. Therefore, the applicants define herein an optimal particle size range that delivers both optimal cleaning and exfoliating performance, and usage experience.

The abrasive particles have size defined by their area-equivalent diameter (ISO 9276-6:2008(E) section 7) also called Equivalent Circle Diameter ECD (ASTM F1877-05 Section 11.3.2). Mean ECD of particle population is calculated as the average of respective ECD of each particles of a particle population of at least 10 000 particles, preferably above 50 000 particles, more preferably above 100 000 particles after excluding from the measurement, and calculation the data of particles having area-equivalent diameter (ECD) of below 10 micrometers. Mean data are extracted from volume-based vs. number-based measurements.

In a preferred embodiment, the abrasive particles have a mean ECD from 10 μm to 1000 μm, preferably from 50 μm to 500 μm, more preferably from 100 μm to 400 μm and most preferably from 150 to 355 μm.

Natural Particles

The compositions herein comprise abrasive particles selected from the group consisting of nut shell particles, particles derived from other plant sources, such as but not limited to stems, roots, leaves, seeds, fruits, wood and mixtures thereof. Such particles are comprised at a level of greater than 2% by weight of the total composition.

In a preferred embodiment, such abrasive particles are comprised at a level of greater than 2.5%, preferably greater or equal to 3%, more preferably between 3% and 10%, most preferably between 3% and 6%, by weight of the composition.

In an embodiment, the abrasive particles are nut shell particles which are typically derived by shearing, graining, milling and/or grinding nut shells. Preferably nut shells are selected from the group consisting of walnut shell, almond shell, hazelnut shell, *macadamia* nut shell, pine nut shell and mixtures thereof. Most preferred nut shell is walnut shell.

When other plant sources are used to produce the abrasive particles of the present composition, they are preferably derived from rice, corn cob, palm biomass, bamboo, kenaf, loofa, apple seeds, apricot stone, olive stone, cherry stone, Tagua palm (*Phyleteas* genus) seed, Doum palm (*Hyphaene* genus) seed, Sago palm (*Metroxylon* genus) seed, wood and mixtures thereof. Preferred are particles derived from wood, olive stone, cherry stone, and tagua palm seed endosperm known as vegetable ivory.

The abrasive particles used herein may be coated, coloured, and/or bleached in any suitable manner available in the art to achieve particles with an appearance that can provide a more appealing product aesthetics.

The bleaching process is also knowingly helping to inhibit bacterial, mold or fungus growth inherently present in nature-derived products.

The abrasive particles of the present invention provide a dual benefit to the user: Firstly, excellent removal of tough food soils from dishware without substantially damaging delicate surfaces such as stainless steel, Inox®, Teflon®, painted and or decorated ceramic, crystal, and plastics; and secondly, hand skin care benefits, mainly skin softness/smoothness and improved skin appearance, through mild skin exfoliation.

Combination of Natural Particles and Other Particles

The compositions herein may further comprise other particles such as polymeric particles. Typically, all abrasive particles will have HV Vickers hardness scale below 50 kg/mm$^2$.

It has been found that compositions containing both the natural abrasive particles, described above, and polymeric particles, show improved cleaning and/or exfoliation, thus reducing the required level of natural particles to achieve the same benefit when used alone. At the same time such benefits may be attained whilst maintaining the level of polymeric particles at a minimum in order to minimize the impacts on the environment when said polymeric particles are not biodegradable.

In a preferred embodiment, when the composition comprises both natural particles and polymeric particles, the ratio of natural particles to polymeric particles is from 50 to 1, preferably from 30 to 3, more preferably from 25 to 4, even more preferably from 20 to 6.

In an embodiment the level of natural particles is from 2.5% to 6%, preferably from 3% to 6%, more preferably from 3% to 5%, most preferably from 3% to 4%, by weight of the composition, and the level of polymeric particles is from 0.1% to 2.5%, preferably from 0.1% to 1%, more preferably from 0.1% to 0.5%, even more preferably from 0.1% to 0.25%, by weight of the composition.

Polymeric Particles

In one embodiment the polymeric particles herein may be produced by shearing, graining, milling and/or grinding a rigid polymeric foam made from polyurethane; polyhydroxy alkanoate derivatives (PHA) such as but not limited to polyhydroxy butyrate, polyhydroxy hexanoate, polyhydroxy valerate, polyhydroxy butyrate-valerate, polyhydroxy butyrate-hexanoate and mixtures thereof; aliphatic polyesters such as polybutylene succinate (PBS), polybutylene adipate (PBA), polybutylene succinate-co-adipate (PBSA) and mixtures thereof; polylactic acid derivatives (PLA); polystyrene; melamine-formaldehyde; polyacrylate; polyolefins such as polyethylene, polypropylene; polyvinyl chloride; and/or polyvinyl acetate.

In a preferred embodiment the particles herein are substantially biodegradable and the polymeric foam is selected from the group consisting of degradable polyurethane; polyhydroxy alkanoate derivatives (PHA) such as but not limited to polyhydroxy butyrate, polyhydroxy hexanoate, polyhydroxy valerate, polyhydroxy butyrate-valerate, polyhydroxy butyrate-hexanoate and mixtures thereof; aliphatic polyesters such as polybutylene succinate (PBS), polybutylene adipate (PBA), polybutylene succinate-co-adipate (PBSA) and mixtures thereof; polylactic acid derivatives (PLA); and mixtures thereof. By "degradable polyurethane" it is herein meant polyurethane made from a reaction of isocyanate monomers and a degradable polyol with and/or without natural or degradable fillers, as will be discussed in more detail below.

Such polymeric foams are synthesized to feature specific density, pore size, brittleness, and hardness.

Most preferably the abrasive particles comprise polymeric particles made from a rigid polyurethane foam formed in the reaction between diisocyanate monomers and polyols.

Such polymeric particles are selected to feature effective shapes, e.g.: defined by roughness, solidity and circularity; and adequate hardness.

It has surprisingly been found that the polymeric particles show a good cleaning performance and mild skin exfoliation, even at relatively low levels, such as from 0.1% to 10%, more preferably from 0.5% to 5%, even more preferably from 0.2% to 3%, most preferably from 0.5% to 2%, by weight of the total composition of said polymeric particles.

In a preferred embodiment the polymeric abrasive particles are non-rolling. e.g.: defined by circularity to promote effective sliding of the abrasive particles vs. typical abrasive particles, where more effective rolling movement is rather promoted. Typically, the circularity to meet the criteria, to promote effective sliding rather than rolling of the particles is at range from 0.1 to 0.4.

In another preferred embodiment the polymeric abrasive particles are sharp. The applicant has found that non-rolling and/or sharp abrasive particles provide better cleaning performance. The applicant has found that very specific particle shapes aid in achieving good soil removal while limiting and/or substantially eliminating the risk of scratching the dishware and of damaging the skin of the user, and at the same time delivering the highly desirable mild skin exfoliation.

The shape of the polymeric abrasive particle can be defined in a number of ways. The present invention defines the polymeric abrasive particle shape in a form of particle, which reflects the geometrical proportions of a particle and more pragmatically of the particle population. Very recent analytical techniques allow an accurate simultaneous measurement of particle shapes from a large number of particles, typically greater than 10000 particles (preferably above 100 000). This enables accurate tuning and/or selection of average particle population shape with discriminative performance. These measurement analyses of particle shape are conducted using on Occhio Nano 500 Particle Characterisation Instrument with its accompanying software Callistro version 25 (Occhio s.a. Liege, Belgium). This instrument is used to prepare, disperse, image and analyse the particle samples, as per manufacturer's instructions, and the following instrument setting selections: White Requested=180, vacuum time=5000 ms, sedimentation time=5000 ms, automatic threshold, number of particles counted/analyses=8000 to 500000, minimum number of replicates/sample=3, lens setting 1×/1.5×.

The polymeric abrasive particles of the present invention are defined by quantitative description of a shape. In quantitative description, shape descriptor is understood as numbers that can be calculated from particle images or physical particle properties via mathematical or numerical operations.

While particle shape can be defined in 3-dimension with dedicated analytical technique, the applicant has found, that the characterization of the particles shape in 2-dimension is most relevant and correlates with the abrasive performance of the abrasive particles. During the particle shape analysis protocol, the particles are orientated toward the surface—via gravity deposition—similarly to the expected particle orientation during the cleaning process. Hence, the present invention regards the characterization of 2-D shape of a particle/particle population as defined by the projection of its shape on the surface on which the particle/particle population is deposited.

The polymeric abrasive particles herein preferably have sharp edges and each particle has at least one edge or surface having concave curvature. More preferably, the particles herein have a multitude of sharp edges and each particle has at least one edge or surface having concave curvature. The sharp edges of the particles are defined by edges having a tip radius below 20 μm, preferably below 8 μm, most preferably below 5 μm. The tip radius is defined by the diameter of an imaginary circle fitting the curvature of the edge extremity. FIG. 1 is an illustration of a tip radius.

Roughness of the Polymeric Particles

Roughness is a quantative, 2-dimensional image analysis shape description, and is being measured according to ISO 9276-6:2008(E) section 8.2 as implemented via the Occhio Nano 500 Particle Characterisation Instrument with its accompanying software Callistro version 25 (Occhio s.a. Liege, Belgium).

Roughness is useful in polymeric abrasive particles since the particle herein has preferably a significant mass of material, available at the periphery of its core, as useful abrasives. This peripheral mass is useful for optimal cleaning and exfoliating performance and also for preventing the particle from rolling.

Roughness is defining in 2D measurements the equivalent useful surface area outside of the core surface area of the particles ranging 0-1, wherein a roughness of 0 describes a particle with no useful mass available at the periphery of the core particle mass.

Roughness is calculated as follows:

$$Rg\gamma=(A-A(O\gamma)/A$$

Where A is the area of the particle and A(Oγ) is the surface area of what is considered the "core of the particle". A−A(Oγ) represent the "useful area at the periphery of the particle and the roughness represents the fraction of that useful area vs. the total particle area. Oγ is called the tunable tolerance factor and is typically set at 0.8, therefore the roughness definition is Rgγ=(A−A(0.8)/A. In order to calculate the A(0.8), the maximum amount of discs are inscribed within the particle contour at each point of the particle's edge. The size, e.g.: area of the discs inscribed is defined by the Discs' diameters whereas the diameter value ranges between 0.8×Dmax and Dmax (where Dmax is the diameter value of the biggest disc inscribed in the particle). The core area of the particle A(0.8) is defined by the area corresponding to the projection of all the inscribed discs.

Figure 2:
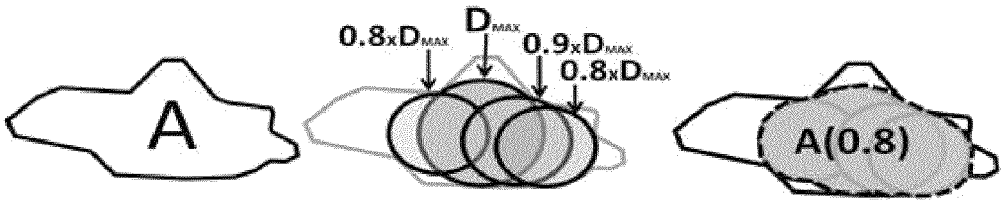
FIG. 2 is an illustration how to calculate roughness from the particle.

FIG. 2 is drawing showing how to calculate roughness from the particle.

In a preferred embodiment, the abrasive polymeric particles have a mean roughness from 0.1 to 0.3, preferably from 0.15 to 0.28 and more preferably from 0.18 to 0.25. Without wishing to be bound by theory, it is believed that such mean roughness contributes in providing improved cleaning performance and surface safety, and highly desirable mild skin exfoliation by increasing the average surface area contacting the surface to be treated. Mean data are extracted from volume-based vs. number-based measurements.

Circularity of the Polymeric Particles

Circularity is a quantitative, 2-dimension image analysis shape description and is being measured according to ISO 9276-6:2008(E) section 8.2 as implemented via the Occhio Nano 500 Particle Characterisation Instrument with its accompanying software Callistro version 25 (Occhio s.a. Liege, Belgium). Circularity is a preferred mesoshape descriptor and is widely available in shape analysis instrument such as in Occhio Nano 500 or in Malvern Morphologi G3. Circularity is sometimes described in literature as being the difference between a particle's shape and a perfect sphere. Circularity values range from 0 to 1, where a circularity of 1 describes a perfectly spherical particles or disc particle as measured in a two dimensional image.

$$C=\sqrt{\frac{4\pi A}{P^2}}$$

Where A is projection area, which is 2D descriptor and P is the length of the perimeter of the particle.

In a preferred embodiment the polymeric abrasive particles have a mean circularity of from 0.1 to 0.4, preferably from 0.15 to 0.35 and more preferably from 0.2 to 0.35. Without wishing to be bound by theory it is believed that this circularity provides the improved cleaning performance and surface safety, and the highly desirable mild skin exfoliation by allowing enough resistance to rolling to provide required shearing of the grease and/or effective removal of the dead cells of the outermost layer of the skin. Mean data are extracted from volume-based vs. number-based measurements.

Solidity of the Polymeric Particles

Figure 3:
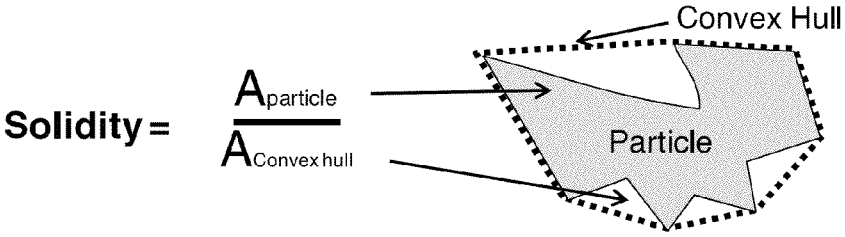
FIG. 3 is an illustration of the convex hull area and particle area.

Solidity is a quantitative, 2-dimensional image analysis shape description, and is being measured according to ISO 9276-6:2008(E) section 8.2 as implemented via the Occhio Nano 500 Particle Characterisation Instrument with its accompanying software Callistro version 25 (Occhio s.a. Liege, Belgium). The particle herein has preferably at least one edge or surface having a concave curvature. Solidity is a mesoshape parameter, which describes the overall concavity of a particle/particle population. Solidity values range from 0 to 1, where a solidity number of 1—-describes a non-concave particle, as measured in literature as being:

$$\text{Solidity}=A/Ac$$

Where A is the area of the particle and Ac is the area of the convex hull (or convex envelope) bounding the particle. The area of the convex hull is better understood with the aid of FIG. 3. In FIG. 3, the convex hull is clearly identified by the dotted line that connects all outermost edges of the particle, and the area of the convex hull is the area enclosed therein.

In a preferred embodiment, the abrasive polymeric particles have a mean solidity of from 0.4 to 0.75, preferably solidity from 0.5 to 0.7 and more preferably from 0.55 to 0.65. Mean data are extracted from volume-based vs. number-based measurements.

Solidity is sometime also named convexity in literature or in some apparatus software using the solidity formula in place of its definition described in ISO 9276-6 (convexity=Pc/P where P is the length of the perimeter of the particle and $P_c$ is length of the perimeter of the convex hull—envelope-bounding the particle). Despite solidity and convexity being similar mesoshape descriptor in concept, the applicant refers herein to the solidity measure expressed above by the Occhio Nano 500, as indicated above.

By the term "mean circularity", "mean solidity" or "mean roughness", the applicant considers the average of the circularity or solidity or roughness values of each particle taken from a population of at least 10 000 particles, preferably above 50 000 particles, more preferably above 100 000 particles, after excluding from the measurement and calculation, the circularity or solidity or roughness data of particles having area-equivalent diameter (ECD) of below 10 microns. Mean data are extracted from volume-based vs. number-based measurements.

Figure 4A:
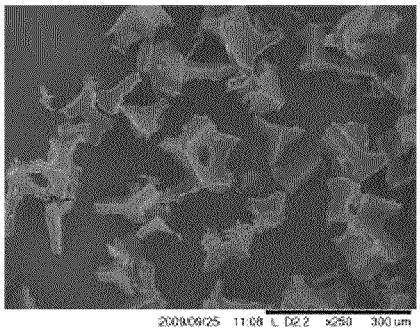
FIG. 4*a* is an electron microscopy image showing polyurethane particle A.
Figure 4B:
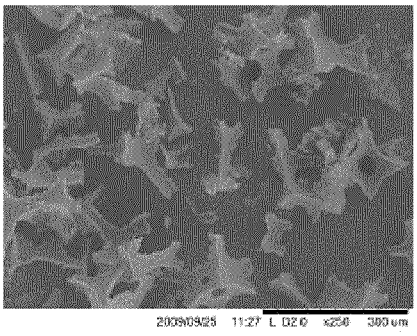
FIG. 4*b* is an electron microscopy image showing polyurethane particle B.

FIG. 4*a* is an electron microscopy image showing polyurethane particle A (generated from polyurethane foam having density of 60 kg/m$^3$) abrasive particles according to the present invention and FIG. 4*b* is an electron microscopy image showing polyurethane particle B (generated from polyurethane foam having density of 33 kg/m$^3$) abrasive particles according to the present invention.

In a preferred embodiment polymeric abrasive particles are produced from polyurethane foam, which is formed in the reaction between diisocyanate monomers and polyols, wherein the diisocyanate monomer can be aliphatic and/or aromatic, in the presence of catalyst, materials for controlling the cell structure and surfactants. Polyurethane foam can be made in a variety of densities and hardness's by varying the type of diisocyanate monomer(s) and polyols and by adding other substances to modify their characteristics. Other additives can be used to improve the stability of the polyurethane foam and other properties of the polyurethane foam. Particles used for the present invention need to be hard enough to provide good cleaning and exfoliating properties without damaging the surface onto which the composition has been applied, and without over-exfoliating. Polyurethane is highly preferred in compositions according to the present invention in view of its effective processability into a foam structure with different densities, the hardness range that can be achieved, and the potential to produce biodegradable foam versus other materials, and in particular versus other polymers.

Though the properties of the polyurethane foam are determined mainly by the choice of the polyol, the disiocyanate has some influence. The choice of diisocyanate affects the stability of the polyurethane upon exposure to light. Polyurethane foams made from aromatic diisocyanates yellow with exposure to light, whereas those made from aliphatic diisocyanates are color-stable. Due the discoloration of the polyurethane foam containing aromatic diisocyanates, aliphatic diisocyanates are preferred in production of polyurethane foam. However applicant has discovered that by mixing aliphatic and aromatic diisocyanate monomers and keeping the aromatic diisocyanate monomer levels below 60% of the weight of the diisocyanates, preferably below 50% and more preferably below 40% of the weight of the diisocyanates, color-stable foam and polyurethane foam particles can be provided for the use as cleaning abrasives in the present invention.

Suitable diisocyanate monomers used herein are aliphatic diisocyanate monomers preferably selected from the group consisting of hexamethylen diisocyanate (HDI), dicyclohexyl methane diisocyanate (H12MDI), isophorone diisocyanate (WI), lysine or lysine ester diisocynate (LDI), trimers of previous and mixtures thereof.

The choice of polyols is not having a great impact to the color stability of the foam, but more impact to the foam hardness and biodegradability.

Example of suitable polyols used herein are preferably selected from the group consisting of castor and/or soybean oil (including ethoxylated or propoxylated oils, including sulfated oils); sugars and polysugars such as glucose, sucrose, dextrose, lactose, fructose, starch, cellulose; sugar alcohols such as glycol, glycerol, erythritol, thereitol, arabitol, xylitol, ribitol, mannitol, sorbitol, dulcitol, iditol, isomalt, maltitol, lactitol, polyglycitol and trimethylolpropane.

Common useful polyols are also achieved by the reaction of previous polyols (including derivative from toluene dianiline) with diethanol amine and propylene oxide (a non-exhaustive example is "sucrose" propoxylate).

Other suitable polyols to be used herein are ethylene glycol and polymeric derivatives such as polyethylene glycol diol, propylene glycol and polymeric derivatives such as polypropylene glycol diol, tetratmethylene glycol and polymeric derivatives such as polytetramethylene glycol.

Polyester polyols are also suitable polyols and polyester polyols resulting from the reaction of acids (adipic, succinic, dodecandioc, azelaic, phtalic anhydride, isophthalic, terephtalic) and alcohols (ethylene glycol, 1,2 propylene glycol, 1,4 butane diol, 2-CH3-1,3-propane diol, neopentyl glycol, diethylene glycol, 1,6-hexanediol, trimethylol propane, glycerin). Non-exhaustive examples are polyethylenediol adipate, polypropylenediol adipate, polybutanediol adipate.

Other suitable polyols are polyethylene terephtalate and co-polymers derivatives such as polytheylene terephtalate glycols, acrylic polyols, polycarbonate polyols, polyols derived from dimethyl carbonate reacted with polyols such as hexanediol, mannich polyols and amine terminated polyols and polycaprolactone polyols and mixtures thereof. Mixtures of previous alcohols are at times desirable to achieve the right chemical and mechanical properties of the polyurethane foams.

Preferred polyols used herein are selected from the group consisting of polypropylene glycol, polytetramethylene glycol having a molecular weight from 400 to 4000, soybean oil and castor oil and mixtures thereof.

Most preferred polyols are selected from the group consisting of ethylene glycol, glycerol, polyethylene glycol, polypropylene glycol, polytetramethylene glycol, polycaprolactonediol, poly(ethylene adipate)diol, poly(hexamethylene adipate)diol, castor oil, soy bean oil, sugars and polysugars and mixtures thereof.

The choice of polyol has effect on the biodegradability and the hardness of the polyurethane foam. For instance, in order to achieve the manufacture of biodegradable foams, preferable selection of polyols are hydrophilic polyols such as ethyleneglycol-based or caprolactone-based-polyols and/or polyols containing cleavable ester or carboxylic anhydride function such as adipate-based polyols, optionally mixed with natural polyols such as sugars and sugar alcohol derivatives, castor oil and mixtures thereof.

Alternatively, the addition of bioactive or biodegradable material during the foaming process is also a mean to achieve sufficient biodegradability of the resulting polyurethane composite. Especially, the addition of lignin, molasses, polyhydroxyalkanoates, polylactide, polycaprolactone, or aminoacid are especially preferred.

Additionally abrasive particles can be produced from the polyurethane foam, which is formed from the mixture of aliphatic diisocyanate and aromatic diisocyanate monomers and polyols. In the diisocyanate mixture comprising aliphatic and aromatic diisocyanates, the aromatic diisocyanate monomers comprise less than 60% of the weight of the diisocyanates, preferably less than 50% and more preferably less than 40% of the weight of the diisocyanates. Suitable aromatic diisocyanate monomers used herein are selected from the group consisting of toluene diisocyanate (TDI), methylene diphenyl diisocyanate (MDI), polymeric methylene diphenyl diisocyanate (PMDI), polymeric toluene diisocyanate (PTDI) and mixtures thereof.

There are two main polyurethane foam variants: one in which most of the foam cells remain closed, and the gas(es) remains trapped, the other being systems which have mostly open cells (i.e. interconnected porosity). In present invention open cell structure is preferred foam variant with minimum pending wall membrane residual. The desired cell structure is directly linked to the optimal particle size desired as per the application e.g.: large cell size is more suitable to achieve larger particle sizes and vice-et-versa.

Figure 5A:
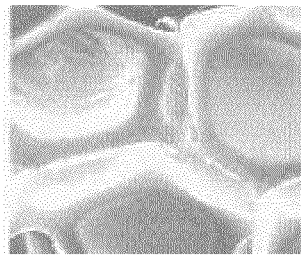
FIG. 5*a* is an electron microscopy image showing closed cell polyurethane foam with wall membrane.
Figure 5B:
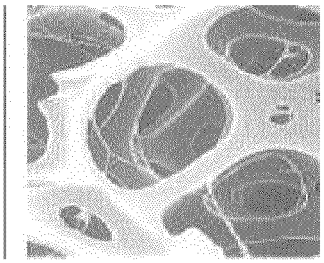
FIG. 5*b* is an electron microscopy image showing open cell polyurethane foam without wall membrane.

FIG. 5*a* is an electron microscopy image showing closed cell polyurethane foam with wall membrane and FIG. 5*b* is an electron microscopy image showing open cell polyurethane foam without wall membrane according to the present invention.

The applicant has found that good cleaning effect will be achieved with the abrasive particles, which have been made from the polyurethane foam having density of up to 500 $kg/m^3$. However the applicant has surprisingly found that significantly better cleaning and exfoliating effect can be achieved when the polyurethane foam density is below 100 $kg/m^3$, more preferably from 50 $kg/m^3$ to 100 $kg/m^3$ and most preferably from 5 $kg/m^3$ to 50 $kg/m^3$. Without wishing to be bound by theory it is believed that the final shape of the particles is driven by the density of the polyurethane foam, if the density of the foam is too high then the resulting particles, following shearing, graining, milling and/or grinding of the foam, would have a more circular shape and less sharp edges, and will provide less cleaning and exfoliating performance due to suboptimal particle shape as determined by the shape parameters described herein.

Figure 6A:
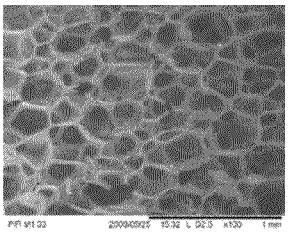
FIG. 6*a* is an electron microscopy image showing polyurethane foam having a density of 33 $kg/m^3$
Figure 6B:
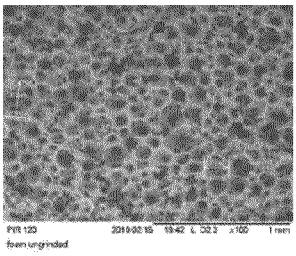
FIG. 6*b* is an electron microscopy image showing polyurethane foam having a density of 120 $kg/m^3$
Figure 6C:
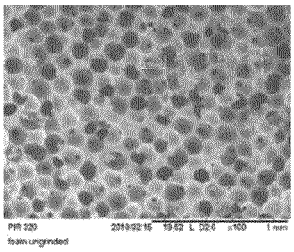
FIG. 6*c* is an electron microscopy image showing polyurethane foam having a density of 320 $kg/m^3$
Figure 7A:
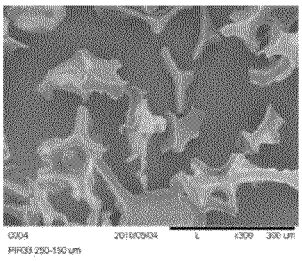
FIG. 7*a* is an electron microscopy image showing polyurethane particles derived from the polyurethane foam shown in FIG. 6*a*
Figure 7B:
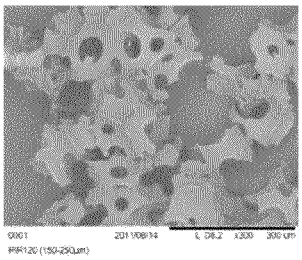
FIG. 7*b* is an electron microscopy image showing polyurethane particles derived from the polyurethane foam shown in FIG. 6*b*
Figure 7C:
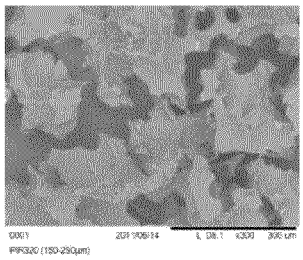
FIG. 7*c* is an electron microscopy image showing polyurethane particles derived from the polyurethane foam shown in FIG. 6*c*

FIGS. 6*a*, 6*b* and 6*c* are electron microscopy images of polyurethane foams having a density of 33 $kg/m^3$, 120 $kg/m^3$, and 320 $kg/m^3$ respectively. FIGS. 7*a*, 7*b* and 7*c* are electron microscopy images of polyurethane particles derived from the polyurethane foams shown in FIGS. 6*a*, 6*b* and 6*c* respectively.

Preferred abrasive particles suitable for use herein are hard enough to provide good cleaning/cleansing performance, whilst providing a good surface safety profile, and highly desirable mild skin exfoliaticin.

Preferred abrasive cleaning and exfoliating particles in the present invention have hardness from 3 to 50 $kg/mm^2$, preferably from 4 to 25 $kg/mm^2$ and most preferably from 5 to 15 $kg/mm^2$ on the HV Vickers hardness.

Vickers Hardness Test Method:

Vickers hardness HV is measured at 23° C. according to standard methods ISO 14577-1, ISO 14577-2, ISO 14577-3. The Vickers hardness is measured from a solid block of the raw material at least 2 mm in thickness. The Vickers hardness micro indentation measurement is carried out by using the Micro-Hardness Tester (MHT), manufactured by CSM Instruments SA, Peseux, Switzerland.

As per the ISO 14577 instructions, the test surface should be flat and smooth, having a roughness (Ra) value less than 5% of the maximum indenter penetration depth. For a 200 μm maximum depth this equates to a Ra value less than 10 μm. As per ISO 14577, such a surface may be prepared by any suitable means, which may include cutting the block of test material with a new sharp microtome or scalpel blade, grinding, polishing or by casting melted material onto a flat, smooth casting form and allowing it to thoroughly solidify prior testing.

Suitable general settings for the Micro-Hardness Tester (MHT) are as follows: Material of intender tip: Vickers Pyramid Shape/Diamond Tip Alternatively, hardness of the abrasive particles in the present invention may also expressed accordingly to the MOHS hardness scale. Preferably, the particles MOHS hardness is comprised between 0.5 and 4 and most preferably between 1 and 3. The MOHS hardness scale is an internationally recognized scale for measuring the hardness of a compound versus a compound of known hardness, see Encyclopedia of Chemical Technology, Kirk-Othmer, 4th Edition Vol 1, page 18 or Lide, D. R (ed) CRC Handbook of Chemistry and Physics, 73rd edition, Boca Raton, Fla.: The Rubber Company, 1992-1993. Many MOHS Test kits are commercially available containing material with known MOHS hardness. For measurement and selection of abrasive material with selected MOHS hardness, it is recommended to execute the MOHS hardness measurement with un-shaped particles e.g.: with spherical or granular forms of the abrasive material since MOHS measurement of angular particles will provide erroneous results.

In order to favor the reduction of the foam into particle, the foam has preferable sufficient brittleness, e.g.: upon stress, the foam has little tendency to deform and is liable to fracture.

In one preferred example, the abrasive polyurethane particles used in the present invention remain visible when liquid composition is stored into a bottle while during the effective cleaning process abrasive particles disperse or break into smaller particles and become invisible to an eye.

One suitable way of reducing the foam to the abrasive particles herein is to grind or mill the foam. Other suitable means include the use of eroding tools such as a high speed eroding wheel with dust collector wherein the surface of the wheel is engraved with a pattern or is coated with abrasive sandpaper or the like to promote the foam to form the abrasive particles herein.

Alternatively and in a highly preferred embodiment herein, the foam may be reduced to particles in several stages. First the bulk foam can be broken into pieces of a few cm dimensions by manually chopping or cutting, or using a mechanical tool such as a lumpbreaker, for example the Model 2036 from S Howes, Inc. of Silver Creek, N.Y. In a second stage, the lumps are agitated using a propeller or saw toothed disc dispersing tool, which causes the foam to release entrapped water and form liquid slurry of polymer particles dispersed in aqueous phase. In a third stage, a high shear mixer (such as the Ultra Turrax rotor stator mixer from IKA Works, Inc., Wilmington, N.C.) can be employed to reduce the particle size of the primary slurry to that required for abrasive particles.

Preferably the abrasive particles obtained via grinding or milling operation are single particles, which do not have cell structure.

Suspending Aids (or Structurants)

The present invention comprises one or more suspending aids selected from the group consisting of crystalline wax structurants, amido-gellants, micro fibril cellulose (MFC), di-benzylidene polyol acetal derivatives, and mixtures thereof. These suspending aids may form a thread-like structuring system throughout the matrix of the composition that prevents the abrasive particles from sedimenting or creaming in the product, thereby providing excellent stability of a hand dishwashing liquid composition. Such stability allows formulating particles of densities different from that of the liquid composition, and of the preferred particle size (i.e. area-equivalent diameter) of 50 to 400 microns, more preferably 150 to 355 microns to deliver efficient cleaning without damaging delicate surfaces, and highly desirable mild skin exfoliation.

When present, said crystalline wax structurant will typically be comprised at a level of from 0.02% to 5%, preferably 0.025% to 3%, more preferably from 0.05% to 2%, most preferably from 0.1% to 1.5% by weight of the total composition. Preferred crystalline wax structurants are hydroxyl-containing crystalline structuring agents such as a hydroxyl-containing fatty acid, fatty ester or fatty soap wax-like materials. Said crystalline hydroxyl-containing structuring agent is insoluble in water under ambient to near ambient conditions.

The preferred crystalline hydroxyl-containing structuring agent is selected from the group consisting of structuring agents with formula (I), (II), or mixtures thereof.

Formula (I)

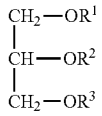

Wherein R' is the chemical moiety described below $R^1$ is

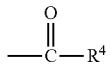

$R^2$ is $R^1$ or H $R^3$ is $R^1$ or H $R^4$ is independently $C_{10}$-$C_{22}$ alkyl or alkenyl comprising at least one hydroxyl group;

Formula (II)

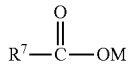

wherein: $R^7$ is $R^4$ as defined above in (I), M is $Na^+$, $K^+$, $Mg^{++}$ or $Al^{3+}$, or H, Some preferred hydroxyl-containing stabilizers include 12-hydroxystearic acid, 9,10-dihydroxystearic acid, tri-9,10-dihydroxystearin and tri-12-hydroxystearin. Tri-12-hydroxystearin is most preferred for use in the hand liquid dishwashing compositions herein.

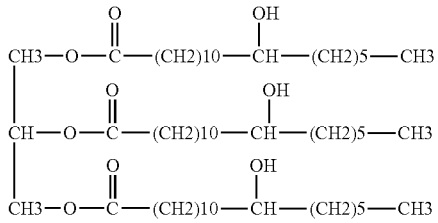

Trihydroxystearin

Castor wax or hydrogenated castor oil is produced by the hydrogenation (saturation of triglyceride fatty acids) of pure castor oil and is mainly composed of tri-12-hydroxistearin.

Commercially available, castor oil-based, crystalline, hydroxyl-containing suspending aids include THIXCIN® from Rheox, Inc. (now Elementis).

Another preferred rheology modifier for use in the present invention is micro fibril cellulose (MFC) such as described in US 2008/0108714 (CP Kelco) or US2010/0210501 (P&G): micro fibril cellulose, bacterially derived or otherwise, can be used to provide suspension of particulates in surfactant-thickened systems as well as in formulations with high surfactant concentrations. Such MFC is usually present at concentrations from about 0.01% to about 1%, but the concentration will depend on the desired product. For example, while from 0.02 to 0.05% is preferred for suspending small mica platelets in liquid detergent compositions, higher levels might be needed to suspend larger particles. Preferably, MFC is used with co-agents and/or co-processing agents such as CMC, xanthan, and/or guar gum with the microfibrous. US2008/0108714 describes MFC in combination with xanthan gum, and CMC in a ratio of 6:3:1, and MFC, guar gum, and CMC in a ratio of 3:1:1. These blends allow to prepare MFC as a dry product which can be "activated" with high shear or high extensional mixing into water or other water-based solutions. "Activation" occurs when the MFC blends are added to water and the co-agents/co-processing agents are hydrated. After the hydration of the co-agents/co-processing agents, high shear is generally then needed to effectively disperse the MFC to produce a three-dimensional functional network that exhibits a true yield point. One example of a commercially available MFC is Cellulon® from CPKelko.

In another preferred embodiment, the external structuring system may comprise a di-amido gellant having a molecular weight from 150 g/mol to 1500 g/mol, preferably between 500 g/mol and 900 g/mol. Such di-amido gellants may comprise at least two nitrogen atoms, wherein at least two of said nitrogen atoms form amido functional substitution groups. In one embodiment, the amido groups are different. In a preferred embodiment, the amido functional groups are the same. The di-amido gellant has the following formula:

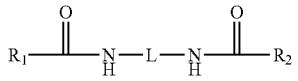

wherein:

$R_1$ and $R_2$ is an amino functional end-group, preferably amido functional end-group, more preferably $R_1$ and $R_2$ may comprise a pH-tuneable group, wherein the pH tuneable amido-gellant may have a pKa of from 1 to 30, more preferably between 2 and 10. In a preferred embodiment, the pH tuneable group may comprise a pyridine. In one embodiment, $R_1$ and $R_2$ may be different.

In a preferred embodiment, may be the same.

L is a linking moeity of molecular weight from 14 to 500 g/mol. In one embodiment, L may comprise a carbon chain comprising between 2 and 20 carbon atoms. In another embodiment, L may comprise a pH-tuneable group. In a preferred embodiment, the pH tuneable group is a secondary amine.

In one embodiment, at least one of R1, R2 or L may comprise a pH-tuneable group. Non-limiting examples of di-amido gellants are:

N,N-(2S,2'S)-1,1'-(dodecane-1,12-diylbis(azanediyl))bis(3-methyl-1-oxobutane-2,1-diypdiisonicotinamide

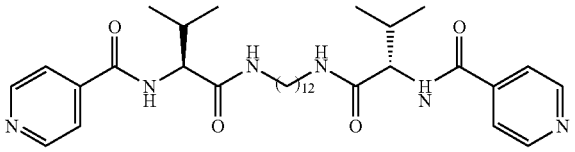

dibenzyl (2S,2'S)-1,1'-(propane-1,3-diylbis(azanediyl))bis (3-methyl-1-oxobutane-2,1-diypdicarbamate

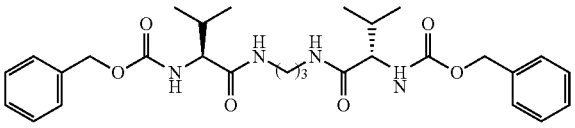

dibenzyl (2S,2'S)-1,1'-(dodecane-1,12-diylbis(azanediyl)) bis(1-oxo-3-phenylpropane-2,1-diyl)dicarbamate

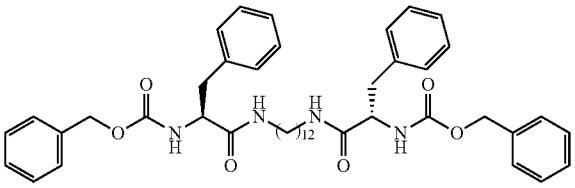

Another preferred embodiment includes Di-benzylidene Polyol Acetal Derivatives (DBPA). The fluid detergent composition may comprise from 0.01% to 1% by weight of a dibenzylidene polyol acetal derivative (DBPA), preferably from 0.05% to 0.8%, more preferably from 0.1% to 0.6%, most preferably from 0.3% to 0.5%. In one embodiment, the DBPA derivative may comprise a dibenzylidene sorbitol acetal derivative (DBS), such as the ones described in U.S. Pat. No. 6,102,999 to Cobb et al. at col. 2, line 43-col. 3, line 65. In another embodiment, the DBPA derivative comprises a sorbitol derivative, a ribitol derivative, a xylitol derivative, a tartrate, or a mixture thereof.

The Hydrophobic Emollient

The composition of present invention may comprise one or more hydrophobic emollients. Hydrophobic emollients are agents that soften or soothe the skin by slowing the evaporation of water. Hydrophobic emollients form an oily layer on the surface of the skin that slows water loss increasing skin moisture content and skin water holding capacity. Without wishing to be bound by theory, it is believed that the hydrophobic emollient complements the skin care benefit provided by the exfoliating particles of the present invention by soothing the exfoliated skin. When a hydrophobic emollient is present, said liquid dishwashing composition according to the present invention comprises high levels of hydrophobic emollient, typically up to 10% by weight. The hydrophobic emollient is preferably present from 0.25% to 10%, more preferably from 0.3% to 8%, most preferably from 0.5% to 6% by weight of the total composition.

Hydrophobic emollients suitable for use in the compositions herein are hydrocarbon oils and waxes; silicones; fatty acid derivatives; glyceride esters, di and tri-glycerides, acetoglyceride esters; alkyl and alkenyl esters; cholesterol and cholesterol derivatives; vegetable oils, vegetable oil derivatives, liquid nondigestible oils, or blends of liquid digestible or nondigestible oils with solid polyol polyesters; natural waxes such as lanolin and its derivatives, beeswax and its derivatives, spermaceti, candelilla, and carnauba waxes; phospholipids such as lecithin and its derivatives; sphingolipids such as ceramide; and mixtures thereof.

Preferred hydrophobic emollients are hydrocarbons like petrolatum, mineral oil and/or blends of petrolatum and mineral oil; tri-glycerides such as the ones derived from vegetable oils including castor oil, soy bean oil, safflower oil, cotton seed oil, corn oil, walnut oil, peanut oil, olive oil, almond oil, avocado oil, coconut oil, jojoba oil, cocoa butter, and the like; oily sugar derivatives such as esters of sucrose with fatty acids; beeswax; lanolin and its derivatives including but not restricted to lanolin oil, lanolin wax, lanolin alcohols, lanolin fatty acids, isopropyl lanolate, cetylated lanolin, acetylated lanolin alcohols, lanolin alcohol linoleate, lanolin alcohol riconoleate, and ethoxylated lanolin.

Enzymes

The composition of the present invention may comprise an enzyme such as an amylase, a protease, a cellulase, a mannanase, a pectinase, a xyloglucanase and/or a lipase; preferably a protease. Without wishing to be bound by theory, it is believed that the protease will interact with the skin surface to provide additional exfoliating benefits.

Enzymes may be incorporated into the compositions in accordance with the invention at a level of from 0.00001% to 1% of enzyme protein by weight of the total composition, preferably at a level of from 0.0001% to 0.5% of enzyme protein by weight of the total composition, more preferably at a level of from 0.0001% to 0.1% of enzyme protein by weight of the total composition.

The aforementioned enzymes can be provided in the form of a stabilized liquid or as a protected liquid or encapsulated enzyme. Liquid enzyme preparations may, for instance, be stabilized by adding a polyol such as propylene glycol, a sugar or sugar alcohol, lactic acid or boric acid or a protease stabilizer such as 4-formyl phenyl boronic acid according to established methods.

Surfactants

A preferred further ingredient of the composition of the present invention is a surfactant selected from nonionic, anionic, cationic surfactants, amphoteric, zwitterionic, semipolar nonionic surfactants, and mixtures thereof. Surfactants may be comprised at a level of from about 1.0% to about 50% by weight, preferably from about 5% to about 40% by weight, more preferably about 10% to about 30% by weight and even more preferably from about 5% to about 20% by weight of the liquid detergent composition. Non-limiting examples of suitable surfactants are discussed below.

In a preferred embodiment, an efficient but mild to hands surfactant system will typically comprise about 4% to about 40%, preferably about 6% to about 32%, more preferably about 11% to about 25%, and most preferably about 11% to about 18% by weight of the total composition of an anionic surfactant and so preferably with no more than about 15%, preferably no more than about 10%, more preferably no more than about 5% by weight of the total composition, of a sulfonate surfactant.

Suitable anionic surfactants to be used in the compositions and methods of the present invention are sulfate, sulfosuccinates, sulfonate, and/or sulfoacetate; preferably alkyl sulfate and/or alkyl ethoxy sulfates; more preferably a combination of alkyl sulfates and/or alkyl ethoxy sulfates with a combined ethoxylation degree less than about 5, preferably less than about 3, more preferably less than about 2.

In an alternative embodiment, the surfactant system could be based on high levels of nonionic surfactant (Such as about 10% to about 45%, preferably about 15 to about 40%, more preferably about 20 to about 35% by weight of the total composition), preferably combined with an amphoteric surfactant, and more preferably with a low level of anionic surfactant (such as less than 20%, preferably less than 10%, more preferably less than about 5% by weight of the total composition).

Sulfate Surfactants

Suitable sulfate surfactants for use in the compositions herein include water-soluble salts or acids of $C_{10}$-$C_{14}$ alkyl or hydroxyalkyl, sulfate and/or ether sulfate. Suitable counterions include hydrogen, alkali metal cation or ammonium or substituted ammonium, but preferably sodium.

Where the hydrocarbyl chain is branched, it preferably comprises $C_{1-4}$ alkyl branching units. The average percentage branching of the sulfate surfactant is preferably greater than 30%, more preferably from 35% to 80% and most preferably from 40% to 60% of the total hydrocarbyl chains.

The sulfate surfactants may be selected from $C_8$-$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303.

Alkyl Sulfosuccinates—Sulfoacetate

Other suitable anionic surfactants are alkyl, preferably dialkyl, sulfosuccinates and/or sulfoacetate. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moiety.es). Preferably, the alkyl moiety is symmetrical.

Sulfonate Surfactants

The compositions of the present invention will preferably comprise no more than 10% by weight, preferably no more than 8%, even more preferably no more than 5% by weight of the total composition, of a sulfonate surfactant. These include water-soluble salts or acids of $C_{10}$-$C_{14}$ alkyl or hydroxyalkyl, sulfonates; $C_{11}$-$C_{18}$ alkyl benzene sulfonates (LAS), modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS). These also include the paraffin sulfonates may be monosulfonates and/or disulfonates, obtained by sulfonating paraffins of 10 to 20 carbon atoms. The sulfonate surfactants also include the alkyl glyceryl sulfonate surfactants.

Amphoteric and Zwitterionic Surfactants

The amphoteric and zwitterionic surfactant may be comprised at a level of from 0.01% to 20%, preferably from 0.2% to 15%, more preferably 0.5% to 12% by weight of the liquid detergent composition. Suitable amphoteric and zwitterionic surfactants are amine oxides and betaines.

Most preferred are amine oxides, especially coco dimethyl amine oxide or coco amido propyl dimethyl amine oxide. Amine oxide may have a linear or mid-branched alkyl moiety. Typical linear amine oxides include water-soluble amine oxides of formula $R^1$—$N(R^2)(R^3)$→O, wherein $R^1$ is a $C_{8-18}$ alkyl moiety; $R^2$ and $R^3$ are independently selected from the group consisting of $C_{1-3}$ alkyl groups and $C_{1-3}$ hydroxyalkyl groups and preferably include methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines), and phosphobetaine.

Examples of suitable betaines and sulfobetaine are the following [designated in accordance with INCI]: Almondamidopropyl of betaines, Apricotamidopropyl betaines, Avocadamidopropyl of betaines, Babassuamidopropyl of betaines, Behenamidopropyl betaines, Behenyl of betaines, betaines, Canolamidopropyl betaines, Capryl/Capramidopropyl betaines, Carnitine, Cetyl of betaines, Cocamidoethyl of betaines, Cocamidopropyl betaines, Cocamidopropyl Hydroxysultaine, Coco betaines, Coco Hydroxysultaine, Coco/Oleamidopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucamidopropyl Hydroxysultaine, Hydrogenated Tallow of betaines, Isostearam idopropyl betaines, Lauramidopropyl betaines, Lauryl of betaines, Lauryl Hydroxysultaine, Lauryl Sultaine, Milkamidopropyl betaines, Minkamidopropyl of betaines, Myristamidopropyl betaines, Myristyl of betaines, Oleamidopropyl betaines, Oleamidopropyl Hydroxysultaine, Oleyl of betaines, Olivamidopropyl of betaines, Palmam idopropyl betaines, Palm itam idopropyl betaines, Palmitoyl Carnitine, Palm Kernelamidopropyl betaines, Polytetrafluoroethylene Acetoxypropyl of betaines, Ricinoleamidopropyl betaines, Sesam idopropyl betaines, Soyamidopropyl betaines, Stearamidopropyl betaines, Stearyl of betaines, Tallowamidopropyl betaines, Tallowamidopropyl Hydroxysultaine, Tallow of betaines, Tallow Dihydroxyethyl of betaines, Undecylenamidopropyl betaines and Wheat Germamidopropyl betaines.

A preferred betaine is, for example, Cocoamidopropyl betaine (Cocoamidopropyl betaine).

A preferred surfactant system is a mixture of anionic surfactant and amphoteric or zwiterionic surfactants in a ratio within the range of 1:1 to 5:1, preferably from 1:1 to 3.5:1.

It has been found that such surfactant system will provide the excellent cleaning and suds profile required from a hand dishwashing liquid composition while being mild to the hands.

Nonionic Surfactants

Nonionic surfactant, when present as co-surfactant, is comprised in a typical amount of from 0.1% to 20%, preferably 0.5% to 15%, more preferably from 0.5% to 10% by weight of the liquid detergent composition. When present as main surfactant, it is comprised in a typical amount of from 0.1 to 45%, preferably 15 to 40%, more preferably 20 to 35% by weight of the total composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 moles of ethylene oxide per mole of alcohol.

Also suitable are alkylpolyglycosides having the formula $R^2O(C_nH_{2n}O)_x$(glycosyl), (formula (V)), wherein $R^2$ of formula (V) is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n of formula (V) is 2 or 3, preferably 2; t of formula (V) is from 0 to 10, preferably 0; and x of formula (V) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having an alkyl group containing from 7 to 21, preferably from 9 to 17, carbon atoms and an amide group selected from $C_8$-$C_{20}$ ammonia amides, monoethanolamides, diethanolamides, and isopropanolamides.

Cationic Surfactants

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of a quaternary ammonium alcohol, such as quaternary chlorine esters.

The Cationic Polymer

The liquid hand dishwashing compositions herein may comprise at least one cationic polymer to deliver skin conditioning benefits that can enhance the soft skin feel provided by the mild skin exfoliating effect delivered by the abrasive particles of the present invention.

When present in the composition, the cationic polymer will typically be present a level of from 0.001% to 10%, preferably from 0.01% to 5%, more preferably from 0.05% to 1%, by weight of the total composition.

Suitable cationic polymers for use in current invention contain cationic nitrogen containing moieties such as quaternary ammonium or cationic protonated amino moieties. Non-limiting examples include cationic polysaccharides such as cationized cellulose derivatives, cationized starch and cationized guar gum derivatives. Also included are synthetically derived copolymers such as homopolymers of diallyl quaternary-ammonium salts, diallyl quaternary ammonium salt/acrylamide copolymers, quaternized polyvinylpyrrolidone derivatives, polyglycol polyamine condensates, vinylimidazolium trichloride/vinylpyrrolidone copolymers, dimethyldiallylammonium chloride copolymers, vinylpyrrolidone/quaternized dimethylaminoethyl methacrylate copolymers, polyvinylpyrrolidone/alkylamino acrylate copolymers, polyvinylpyrrolidone/alkylamino acrylate/vinylcaprolactam copolymers, vinylpyrrolidone/methacrylamidopropyl trimethylammonium chloride copolymers, alkylacrylamide/acrylate/alkylaminoalkylacrylamide/polyethylene glycol methacrylate copolymers, adipic acid/dimethylaminohydroxypropyl ethylenetriamine copolymers.

Preferred cationic polymers are cationic polysaccharides, more preferably cationic cellulose derivatives such as the salts of hydroxyethyl cellulose reacted with trimethyl ammonium substituted epoxide, referred to in the industry (CTFA) as Polyquaternium-10, commercially available examples of which are the UCARE polymer series, ex Dow Amerchol; and/or cationic guar gums derivatives such as guar hydroxypropyltrimonium chloride, commercially available examples of which are the Jaguar® series ex Rhodia, N-Hance® and AquaCat® polymer series available from Aqualon.

Humectant

In a preferred embodiment the composition of the present invention may further comprise one or more humectants. It has been found that such composition comprising a humectant will provide additional hand skin care benefits.

When present, the humectant will typically be present in the composition of the present invention at a level of from 0.1% to 50%, preferably from 1% to 20%, more preferably from 1% to 10%, even more preferably from 1% to 6%, and most preferably from 2% to 5% by weight of the total composition.

Humectants that can be used according to this invention include those substances that exhibit an affinity for water and help enhance the absorption of water onto a substrate, preferably skin. Specific non-limiting examples of particularly suitable humectants include glycerol; diglycerol; polyethyleneglycol (PEG-4) and its derivatives; propylene glycol; hexylene glycol; butylene glycol; (di)-propylene glycol; glyceryl triacetate; lactic acid; urea; polyols like sorbitol, xylitol and maltitol; polymeric polyols like polydextrose and mixtures thereof. Additional suitable humectants are polymeric humectants of the family of water soluble and/or swellable polysaccharides such as hyaluronic acid, chitosan and/or a fructose rich polysaccharide which is e.g. available as Fucogel®1000 (CAS-Nr 178463-23-5) by SOLABIA S. When present, the humectant will further enhance the skin hydration benefit delivered by the mild skin exfoliating effect delivered by the abrasive particles. Removal of the dead cells from the outermost layer of the skin through exfoliation eliminates dry scales and results in visibly more hydrated skin. Humectants will further enhance the hydrated condition of the skin by holding water.

Pearlescent Agent and Opacifiers

The composition of the present invention may comprise either an organic and/or an inorganic pearlescent agent and/or an opacifier in order to provide a composition which is substantially opaque (not substantially clear). A composition is "substantially opaque" as intended herein, if it transmits at most 50% of light at any one wavelength in the visible region i.e. between 400 and 800 nm, preferably 550-700 nm, measured in a 1 cm cuvette in absence of dyes and abrasive particles. Preferably the transmittance is at most 30%, more preferably at most 20%. Pearlescent agents and/or opacifiers make the aesthetics of the particle-containing product more appealing to consumers.

Organic pearlescent agents are typically comprised at an active level of from 0.05% to 2.0% wt, preferably from 0.1% to 1.0% w of the total composition. Suitable organic pearlescent agents include monoester and/or diester of alkylene glycols. Typical examples are fatty monoesters and/or diesters of ethylene glycol, propylene glycol, diethylene glycol, dipropylene glycol, triethylene glycol or tetraethylene glycol. Non limiting examples of commercially available fatty acid esters are PEG6000MS® ex Stepan, Empilan EGDS/A® ex Albright & Wilson, and Euperlan® PK711 produced by Cognis Corp.

Inorganic pearlescent agents, are typically comprised at an active level of from 0.005% to 1.0% wt, preferably from 0.01% to 0.2% by weight of the composition of the 100% active inorganic pearlescent agents. Inorganic pearlescent agents include aluminosilicates and/or borosilicates, preferably silica, metal oxides, oxychloride coated aluminosilicate and/or borosilicates. More preferably inorganic pearlescent agent is mica, even more preferred titanium dioxide treated mica such as BASF Mearlin Superfine. Other commercially available suitable inorganic pearlescent agents are available from Merck under the tradenames Iriodin, Biron, Xirona, Timiron Colorona, Dichrona, Candurin- and Ronastar; from BASF (Engelhard, Mearl) under tradenames Biju, Bi-Lite, Chroma-Lite, Pearl-Glo, Mearlite; and from Eckart under the tradenames Prestige Soft Silver and Prestige Silk Silver Star.

Opacifiers, if present, are comprised at an active level of 0.005% to 1%, preferably from 0.01% to 0.5%, more preferably from 0.02% to 0.3% by weigth of the composition. Suitable materials may be selected from the Acusol™ 0P30X range (ex Rohm and Haas), the PuriColour White range (ex Ciba) and the LameSoft™ range (ex Cognis).

Cleaning Polymer

The liquid hand dishwashing composition herein may optionally further comprise one or more alkoxylated polyethyleneimine polymers. The composition may comprise from 0.01% to 10%, preferably from 0.01% to 2%, more preferably from 0.1% to 1.5%, even more preferable from 0.2% to 1.5% by weight of the total composition of an alkoxylated polyethyleneimine polymer as described on page 2, line 33 to page 5, line 5 and exemplified in examples 1 to 4 at pages 5 to 7 of WO2007/135645 The Procter & Gamble Company.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000 described in BASF patent application WO2007/138053 on pages 2 line 14 to page 10, line 34 and exemplified on pages 15-18.

Other Optional Components:

The liquid detergent compositions herein can further comprise a number of other optional ingredients suitable for use in liquid detergent compositions such as Magnesium ions, solvents, hydrotropes, polymeric suds stabilizers, polymeric rheology modifiers, linear or cyclic carboxylic acids, diamines, perfume, dyes, chelants, pH buffering means. A further discussion of acceptable optional ingredients suitable for use in light-duty liquid detergent composition may be found in U.S. Pat. No. 5,798,505.

Thickness of the Composition

The liquid hand dishwashing compositions herein have preferably a viscosity from 100 to 10000 mPa*s (100-10000 centipoises), more preferably from 200 to 8000 mPa*s (200-8000 centipoises), even more preferably from 400-6500 mPa*s (400-6500 centipoises), and most preferably from 800 to 5000 mPa*s (800-5000 centipoises) at 3.06 $s^{-1}$ and 20° C. Viscosity can be determined by conventional methods. Viscosity according to the present invention is measured using a Brookfield viscometer LVDV II with a cylindrical steel spindle (spindle number 31) according to the manufacturer instructions.

The preferred rheology described therein may be achieved using internal existing structuring with detergent ingredients or by employing an external rheology modifier and/or a structurant, which provides the composition with a pseudoplastic or shear thinning rheology profile and with time-dependent recovery of viscosity after shearing (thixotropy).

The Method of Cleaning/Treating a Dishware

In a preferred embodiment, the method of cleaning a dishware with a liquid dishwashing composition, comprising the abrasive particles described herein, comprises the step of applying said composition onto the dishware surface, typically in diluted and/or neat form and rinsing or leaving said composition to dry on said surface without rinsing said surface.

By "in its neat form", it is meant herein that said liquid composition is applied directly onto the surface to be treated and/or onto a cleaning device or implement such as a dish cloth, a sponge or a dish brush without undergoing any dilution by the user (immediately) prior to the application. By "diluted form", it is meant herein that said liquid composition is diluted by the user with an appropriate solvent, typically water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually 5 to 20 liters.

Process

The process of generating the abrasive particle containing compositions herein comprises the steps of: (i) fragmenting a material selected from the group consisting of nut shells, other plant sources, and mixtures thereof, preferably by shearing, grinding, milling, and/or graining said material, to generate abrasive particles; (ii) adding and/or mixing said abrasive particles to and/or with a composition, preferably a hand dishwashing composition; and (iii) adding and/or mixing one or more suspending aids selected from the group consisting of crystalline wax structurants, amido-gellants, micro fibril cellulose, di-benzylidene polyol acetal derivatives, and mixtures thereof, wherein said abrasive particles are added at a level of greater than 2%, preferably greater than 2.5%, more preferable greater or equal to 3%, by weight of the composition.

In an embodiment steps (ii) and (iii) occur substantially simultaneously. In an alternate embodiment step (iii) may occur prior to step (ii).

Cleaning Performance Test Method

First time "neat" product cleaning performance may be evaluated by the following test method: Tiles, typically glossy, white, enamel 24 cm×4 cm, are prepared by applying to them either 0.6 g pure vegetable oil mix (peanut, sunflower and corn oil at equal proportions) or 0.5 g Knorr white sauce mix (prepared according to the manufacturer instructions). Soils are spread using a paint roller to obtain a uniform layer on top of the tile. Tiles are baked in an oven at 145° C. for 2 hours and 10 minutes (vegetable oil mix) or at 180° C. for 45 minutes (white sauce) and kept in a constant temperature and humidity cabinet (25° C., 70% relative humidity) until used. To test cleaning performance, tiles are placed on a Wet Abrasion Scrub Tester with four cleaning tracks equipped with four sponge holders (such as made by Sheen Instruments Ltd. Kingston, England). Four new cellulose kitchen sponges (such as Spontex®) of dimensions 4 cm×8.5 cm (and 4.5 cm thick) are wetted with 25 g of water at 15 gpg water hardness and placed in the sponge holders. Four g of either test or reference compositions are applied to the sponges. Sponge holders are turned down so that the sponges are placed directly on top of the soiled tile. The abrasion tester can be configured to supply pressure (e.g. 200 g, 400 g, 600 g or 700 g), and move the sponge over the test surface with a set stroke length (e.g.: 30 cm), at set speed (e.g.: 37 strokes per minute). The ability of the composition to remove soil is measured through the number of strokes needed to perfectly clean the surface, as determined by visual assessment. In this context, one stroke means a single movement of the carriage equipped with the four sponges comprising the cleaning product over the plate to be cleaned. The lower the number of strokes, the higher the cleaning ability of the composition.

The soil is regarded as having been removed fully when the operator can no longer see the soil with the naked eye. Eight soiled tiles are used per test and the product position is randomized so that each product is tested in the four different cleaning tracks of the wet Abrasion Scrub Tester at least once.

TABLE 1

Cleaning performance of exemplified hand dishwashing detergent compositions comprising abrasive particles.

| Composition | A | B | C |
|---|---|---|---|
| Alkyl Ethoxy Sulfate AExS | 24 | 24 | 24 |
| Dimehtyl coco alkyl Amine Oxide | 5.3 | 5.3 | 5.3 |
| Ethanol | 3.25 | 3.25 | 3.25 |
| Polypropylene-glycol | 0.7 | 0.7 | 0.7 |
| NaCl | 1.25 | 1.25 | 1.25 |
| Hydrogenated Castor Oil | 0.24 | 0.24 | 0.24 |
| Particles | — | 3% Polyurethane foam particles (1) | 5% Bleached walnut shell particles ~200 μm (2) |
| Minors * | Balance to 100% with water | | |
| pH | 9 | 9 | 9 |
| Number of strokes (white sauce) | 61.2 ± 8.07 | 7 ± 1.51 | 10 ± 1.51 |
| Number of strokes (vegetable grease) | 33.8 ± 4.59 | 7.5 ± 1.77 | 10.5 ± 1.77 |

* Minors: dyes, opacifier, perfumes, preservatives, hydrotropes, processing aids, stabilizers
(1) From foam having foam density 33 kg/m$^3$/Vickers hardness 7 kg/mm$^2$/Blade mill grinded and sieved fraction 50-355 microns
(2) Evonik Industries

TABLE 2

Cleaning performance of exemplified hand dishwashing detergent compositions comprising polyurethane abrasive particles derived from foams of different densities

| Composition | D | E | F |
|---|---|---|---|
| Alkyl Ethoxy Sulfate AExS | 24 | 24 | 24 |
| Dimehtyl coco alkyl Amine Oxide | 5.3 | 5.3 | 5.3 |
| Ethanol | 3.25 | 3.25 | 3.25 |
| Polypropylene-glycol | 0.7 | 0.7 | 0.7 |
| NaCl | 1.25 | 1.25 | 1.25 |
| Hydrogenated Castor Oil | 0.24 | 0.24 | 0.24 |
| Particles | — | 1% Polyurethane foam particles (1) | 1% Polyurethane foam particles (2) |
| Minors * | Balance to 100% with water | | |
| pH | 9 | 9 | 9 |

TABLE 2-continued

Cleaning performance of exemplified hand dishwashing detergent compositions comprising polyurethane abrasive particles derived from foams of different densities

| Composition | D | E | F |
|---|---|---|---|
| Number of strokes (white sauce) | Above 200 | 20 ± 4 | 30 ± 8 |

* Minors: dyes, opacifier, perfumes, preservatives, hydrotropes, processing aids, stabilizers
(1) From foam having foam density 33 kg/m$^3$/Blade mill grinded and sieved fraction 250-355 microns
(2) From foam having foam density 320 kg/m$^3$/Blade mill grinded and sieved fraction 250-355 microns

TABLE 3

Cleaning performance of exemplified hand dishwashing detergent compositions comprising abrasive particles.

| Composition | G | H | I | J |
|---|---|---|---|---|
| Alkyl Ethoxy Sulfate AExS | 24 | 24 | 24 | 24 |
| Dimehtyl coco alkyl Amine Oxide | 5.3 | 5.3 | 5.3 | 5.3 |
| Ethanol | 3.25 | 3.25 | 3.25 | 3.25 |
| Polypropylene-glycol | 0.7 | 0.7 | 0.7 | 0.7 |
| NaCl | 1.25 | 1.25 | 1.25 | 1.25 |
| Hydrogenated Castor Oil | 0.24 | 0.24 | 0.24 | 0.24 |
| Particles | — | 1% walnut shell particles (1) | 3% walnut shell particles (1) | 5% walnut shell particles (1) |
| Minors * | Balance to 100% with water | Balance to 100% with water | Balance to 100% with water | Balance to 100% with water |
| pH | 9 | 9 | 9 | 9 |
| Number of strokes (white sauce) | Above 200 | 79.7 ± 13.6 | 34.0 ± 7.25 | 21.0 ± 2.39 |

* Minors: dyes, opacifier, perfumes, preservatives, hydrotropes, processing aids, stabilizers
(1) Bleached walnut shell particles of 200 microns. Evonik Industries.

TABLE 4

Cleaning performance of exemplified hand dishwashing detergent compositions comprising abrasive particles.

| Composition | K | L | M | N |
|---|---|---|---|---|
| Alkyl Ethoxy Sulfate AExS | 24 | 24 | 24 | 24 |
| Dimehtyl coco alkyl Amine Oxide | 5.3 | 5.3 | 5.3 | 5.3 |
| Ethanol | 3.25 | 3.25 | 3.25 | 3.25 |
| Polypropylene-glycol | 0.7 | 0.7 | 0.7 | 0.7 |
| NaCl | 1.25 | 1.25 | 1.25 | 1.25 |
| Hydrogenated Castor Oil | 0.24 | 0.24 | 0.24 | 0.24 |
| Particles | — | 1% Olive stone particles (1) | 3% Olive stone particles (1) | 5% Olive stone particles (1) |
| Minors * | Balance to 100% with water | Balance to 100% with water | Balance to 100% with water | Balance to 100% with water |
| pH | 9 | 9 | 9 | 9 |
| Number of strokes (white sauce) | Above 200 | 141.6 ± 16.33 | 42.7 ± 13.25 | 22.9 ± 3.24 |

* Minors: dyes, opacifier, perfumes, preservatives, hydrotropes, processing aids, stabilizers
(1) J. Rettenmaier & Söhne Gmbh + Co. KG

TABLE 5

Cleaning performance of exemplified hand dishwashing detergent compositions comprising abrasive particles.

| Composition | O | P | Q | R |
|---|---|---|---|---|
| Alkyl Ethoxy Sulfate AExS | 24 | 24 | 24 | 24 |
| Dimehtyl coco alkyl Amine Oxide | 5.3 | 5.3 | 5.3 | 5.3 |
| Ethanol | 3.25 | 3.25 | 3.25 | 3.25 |
| Polypropylene-glycol | 0.7 | 0.7 | 0.7 | 0.7 |
| NaCl | 1.25 | 1.25 | 1.25 | 1.25 |
| Hydrogenated Castor Oil | 0.24 | 0.24 | 0.24 | 0.24 |
| Olive Stone Particles (1) | — | 3 | 2.75 | — |
| Polyurethane particles (2) | — | — | 0.25 | 0.25 |
| Minors * | Balance to 100% with water | Balance to 100% with water | Balance to 100% with water | Balance to 100% with water |
| pH | 9 | 9 | 9 | 9 |
| Number of strokes (white sauce) | Above 200 | 41.2 ± 6.63 | 24.8 ± 1.9 | 40.8 ± 5.32 |

* Minors: dyes, opacifier, perfumes, preservatives, hydrotropes, processing aids, stabilizers (1) J. Rettenmaier & Söhne Gmbh + Co. KG (2) From foam having foam density 33 kg/m$^3$/Vickers hardness 7 kg/mm$^2$/Blade mill grinded and sieved fraction 50-355 microns Surface Damage Method:

To measure the surface damage produced by the test particles, 4 g of aqueous solutions comprising the particles of the present invention (3%-5% wt particle in deionized water) are applied to new cellulose kitchen sponges (such as Spontex®) of dimensions 4 cm×8.5 cm (and 4.5 cm thick) wetted with 25 g of deionized water mounted on a Wet Abrasion Scrub Tester Instrument as described in the cleaning performance test method with the particle coated side facing the test surface. Two references are used: Reference 1 is the same cellulose kitchen sponge wetted with 25 g deionized water and loaded with 4 g water no particles, Reference 2 is a medium duty scrubbing sponge such as the ones sold by 3M under the trade mark of Scotch-Brite, placed in the Wet Abrasion Scrub tester sponge holder with the green scrubby side facing the test surface, wetted and loaded as Reference 1 sponge. The test surface to be used should be a new sheet of uncolored, transparent, virgin Poly(methyl methacrylate) (also known as PMMA, Plexiglass, Perspex, Lucite), having a Vickers HV Hardness Value of 25 kg/square mm (+/−2) (as measured using standard test method ISO 14577). The abrasion tester should be configured to supply 600 g of pressure and move the sponge over the test surface with a stroke length of 30 cm, at a speed of 37 strokes per minute. The wet abrasion scrub tester should be allowed to execute 200 strokes (i.e., 200 single-direction displacements), then the sponge is re-loaded with an additional 4 g of abrasive particles in water. The sponge is to be reloaded in this manner every 200 strokes, for five consecutive loadings (i.e., 1000 strokes in total per test surface). Assessment of damage to the test surface is conducted after 1000 strokes have been completed.

To assess surface damage on the Poly(methyl methacrylate) test surface, visual grading is conducted according to the following 5-level surface damage grading scale: 0=I see no scratches; 1=I think I see scratches; 2=I definitely see small scratches; 3=I see lots of scratches; 4=I see a lot of damage. The Visual Damage Grade is the average of the grades given by 2 independent graders.

TABLE 6

Visual surface damage grade of exemplified cleaning and abrasive particles dispersed in deionized water at the indicated levels.

| Sample | Visual Surface damage Grading |
|---|---|
| 3% Polyurethane foam particles (1) | 0 |
| 5% Bleached walnut shell particles (2) | 0 |
| Reference 1 - Soft sponge + water | 0 |
| Reference 2- Scrubby sponge + water | 3 |

(1) From foam having foam density 33 kg/m$^3$/Vickers hardness 7 kg/mm$^2$/Blade mill grinded and sieved fraction 50-355 microns (2) Particle size ~200 microns. Evonik Industries Exfoliation Method "In vivo" exfoliation method is based on removal of dihydroxyacetone-induced skin artificial coloration. Dihydroxyacetone has the ability to stain only fully keratinized cells of the epidermis. Removal of the dihydroxyacetone-induced stain is linked to the removal of fully keratinized cells and therefore can provide an estimate of skin exfoliation.

The volar forearm area of both left and right arms of two volunteers is artificially tanned using a commercially available sunless tanner comprising dihydroxyacetone. The sunless tanner is applied once a day during a week according to the manufacturer instructions until a homogeneous artificial tan is obtained.

Three treatment sites per arm are marked off using a water proof marker. The three treatments sites of each arm should be centered on the volar forearem between the wrist and inner elbow. Care should be taken not to use the area closest to inner elbow and wrist. One of the 3 treatment sites in each forearm is a non-particle control which is included to demonstrate the exfoliation benefits provided by the particles. The location of both the non-particle control site and the two particle treatment sites are randomized for each arm and each subject to minimize position effects.

Product treatments: 0.5 ml of each prototype is applied twice a day with at least four hours between product applications for a total of 4 times in their designated treatment site of each forearm. Product is dispensed on the skin using a 2 ml syringe and rubbed with a gloved finger for 10 seconds with circular motions, after all products have been applied in one forearm, skin is rinsed with warm tap water and patted dry with a soft paper tissue taking care not to rub the treatment sites. Skin color measurements are taken as L*,a*,b* values according to the CIELab color scale using a BYK spectro-guide gloss 6801 before each product application, and one hour after the last ($4^{th}$) product application, according to the equipment instructions. The CIELab color scale is based on the Opponent-Colors Theory which assumes that the human eye perceives color as the following pairs of opposites: Light-Dark, Red-Green, Yellow-Blue. The L* value for each scale indicates the level of light or dark, the a* value the redness or greenness, and the b* value the yellowness or blueness.

Figure 8:
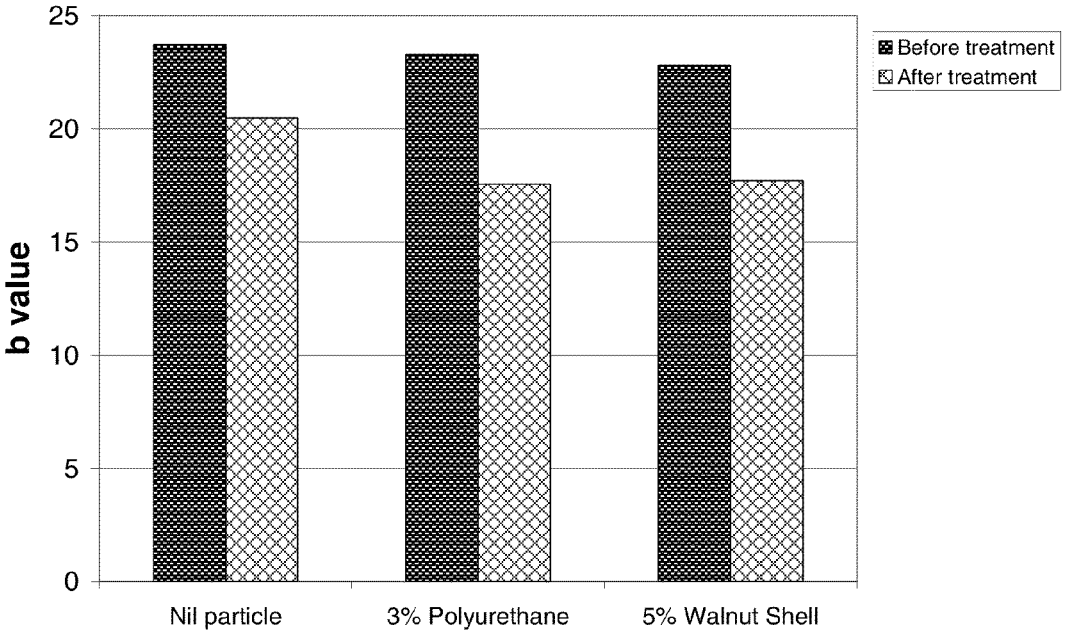
FIG. 8 is a graph illustrating the skin exfoliation performance of a composition comprising polyurethane foam particles or natural particles.

Exfoliation benefits provided by the exemplified hand dish products comprising abrasive particles (compositions S, T, U) are shown in TABLE 8 and FIG. 8 by a decrease in the b* value (color removal) after each treatment (T1 to T4) with particle-containing product, and by the difference in b* value (Δb*) between the color of artificially tanned skin before initiating the product treatment (b*BT) and after the last ($4^{th}$) treatment (b*T4), so that Δb*=b*BT−b*T4. Larger Δb* indicate more color removal and more skin exfoliation. The impact of the particles can be seen by the increase in the Δb* after treatment with the particle-containing prototypes. Similarly, skin treated with the particle prototypes shows a b* value closer to that of not tanned (untreated) skin measured in the inner part of the upper arm and that has an average b* of 15.77, demonstrating that the prototypes with particles are more efficient in removing the layer of dead cells stained with the sunless tanner, and in returning the skin to its original color. Tables 9 and 10 illustrate the effect of level of particles, as % wt of the total composition, on exfoliation using the abovementioned method. The tables indicate effective exfoliation at levels of greater than 2% by weight of natural particles.

TABLE 7

Exemplified hand dishwashing detergent compositions comprising abrasive particles.

| Composition | S | T | U |
|---|---|---|---|
| Alkyl Ethoxy Sulfate AExS | 18 | 18 | 18 |
| Dimehtyl coco alkyl Amine Oxide | 6 | 6 | 6 |
| Citrate | 2.55 | 2.55 | 2.55 |
| Polypropylene-glycol | 0.8 | 0.8 | 0.8 |
| NaCl | 0.5 | 0.5 | 0.5 |
| Particles | — | 3% Polyurethane foam particles (1) | 5% Bleached walnut shell particles ~200 μm (2) |
| Minors * | Balance to 100% with water | | |
| pH | 9 | 9 | 9 |

* Minors: dyes, opacifier, perfumes, preservatives, hydrotropes, processing aids, stabilizers (1) From foam having foam density 33 kg/m$^3$/Vickers hardness 7 kg/mm$^2$/Blade mill grinded and sieved fraction 50-355 microns (2) Evonik Industries

TABLE 8

Average b* value before treatment and after each product treatment

| Product | Dyed skin before treatment with hand dish prototypes (BT) | T-1 | T-2 | T-3 | T-4 | Δb* BT-T4 |
|---|---|---|---|---|---|---|
| S | 23.67 | 23.15 | 21.39 | 21.51 | 21.04 | 2.63 |
| T | 23.29 | 21.62 | 19.45 | 18.99 | 18.07 | 5.22 |
| U | 22.80 | 21.84 | 19.92 | 19.51 | 18.64 | 4.16 |

Average b* value of non-artificially tanned skin i.e. skin of the inner part of the upper arm not treated with sunless tanner comprising dihydroxyacetone is 15.77

TABLE 9

Exemplified hand dishwashing detergent compositions comprising abrasive particles.

| Composition | X | Y | Z |
|---|---|---|---|
| Alkyl Ethoxy Sulfate AExS | 18 | 18 | 18 |
| Dimehtyl coco alkyl Amine Oxide | 6 | 6 | 6 |
| Citrate | 2.55 | 2.55 | 2.55 |
| Polypropylene-glycol | 0.8 | 0.8 | 0.8 |
| NaCl | 0.5 | 0.5 | 0.5 |
| Particles | — | 1% Bleached walnut shell particles ~200 μm (2) | 5% Bleached walnut shell particles ~200 μm (2) |
| Hydrogenated Castor Oil | 0.24 | 0.24 | 0.24 |
| Minors * | Balance to 100% with water | | |
| pH | 9 | 9 | 9 |

(1) Evonik

TABLE 10

Average b* value before treatment and after treatment with each product four times

| Product | Dyed skin before treatment with hand dish prototypes (BT) | Δb* BT − T4 |
|---|---|---|
| X | 22.67 | 2.32 |
| Y | 22.45 | 2.71 |
| Z | 24.06 | 5 |

EXAMPLES

Liquid Dishwashing Detergent Compositions

| % Weight | 1 | 2 | 3 | 4 | 5 | 6 | 7 | 8 | 9 | 10 |
|---|---|---|---|---|---|---|---|---|---|---|
| Alkyl Ethoxy Sulfate | 18 | 24 | 14 | 14 | 9 | — | 5 | 9 | 18 | 24 |
| Linear Alkylbenzene Sulfonate | — | — | — | — | 11 | — | 15 | 4 | — | — |
| Paraffin Sulfonate | — | — | — | 8 | — | — | — | — | — | — |
| Coco amido propyl Betaine | — | — | — | — | 6 | — | — | 4 | — | — |
| Ethoxylated alkyl alcohol | — | — | — | 3 | 2 | 33 | 1 | — | — | — |
| Dimehtyl coco alkyl Amine Oxide | 6 | 5.3 | 4 | — | 2 | 2 | — | — | 6 | 5.3 |
| Alkylpolyglucoside | — | — | — | 6 | — | — | 6 | — | — | — |
| Ethanol | — | 1.5 | 3 | 3 | 1 | 9 | 2 | 3 | — | 1.5 |
| Polypropyleneglycol | 0.8 | 0.7 | 0.2 | — | 0.5 | 0.3 | 0.2 | — | 0.8 | 0.7 |
| Citrate | 2.5 | — | | 0.3 | — | — | — | — | 2.5 | — |
| NaCl | 0.5 | 1.25 | — | — | 0.25 | — | — | 0.5 | 0.5 | 1.25 |
| Sodium cumene sulfonate | — | — | — | 0.6 | — | 3 | 2 | 2 | — | — |
| Polyurethane foam particles (1) | — | 3 | — | — | — | 1 | 0.5 | 0.25 | — | — |

-continued

| % Weight | 1 | 2 | 3 | 4 | 5 | 6 | 7 | 8 | 9 | 10 |
|---|---|---|---|---|---|---|---|---|---|---|
| Polyhydroxybutyrate valerate foam particles (2) | — | — | — | — | — | — | — | — | 2 | — |
| Polylactic acid foam particles (3) | — | — | — | — | — | — | — | — | — | 1.5 |
| Bleached Walnut shell particles ~200 microns (4) | 5 | — | — | 3 | — | — | 2.5 | — | — | — |
| Olive stone particles 150-250 microns (5) | — | — | 3 | — | 5.5 | — | — | — | — | 2.5 |
| Cationic polymer (6) | 0.1 | — | — | — | — | 0.2 | — | — | — | 0.15 |
| Hydrogenated Castor Oil | — | 0.15 | 0.2 | — | 0.2 | — | — | 0.1 | — | — |
| MFC CP Kelko | 0.15 | — | 0.02 | 0.05 | — | 0.03 | 0.1 | — | — | — |
| Dibenzylidene Sorbitol (7) | — | — | — | — | — | — | — | — | 0.3 | — |
| Amido-gellant (8) | — | — | — | 0.2 | — | — | — | — | — | 0.25 |
| Ethylene glycol diesterate | 0.4 | — | — | — | — | 0.8 | — | 0.4 | — | 0.3 |
| Opacifier (9) | — | — | 0.05 | — | 0.02 | | — | — | 0.03 | — |
| Petrolatum | — | — | | — | — | — | 0.5 | — | — | 0.5 |
| glycerol | — | — | | 2 | — | — | — | — | — | 1 |
| Minors | Balance to 100% with water | | | | | | | | | |
| pH | 9 | 9 | 8.7 | 7 | 7 | 6.5 | 6 | 7 | 9 | 8.5 |

* Minors: dyes, perfumes, preservatives, hydrotropes, processing aids, stabilizers (1) From foam having foam density 33 kg/m$^3$/Vickers hardness 7 kg/mm$^2$/Blade mill grinded and sieved fraction 50-355 microns (2) Blade mill grinded and sieved fraction 250-355 microns (3) Blade mill grinded and sieved fraction 150-250 microns (4) Evonik Industries (5) J. Rettenmaier & Söhne Gmbh+Co. KG (6) Guar hydroxypropyl trimonium chloride (7) Millithix 925S Milliken (8) N,N'-(2S,2'S)-1,1'-(dodecane-1,12-diylbis(azanediyl))bis(3-methyl-1-oxobutane-2,1-diyl)diisonicotinamide (9) Acusol ™ OP301 ex. Rohm and Haas The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hand dishwashing composition comprising:

a. one or more suspending aids selected from the group consisting of crystalline wax structurants, amido-gellants, micro fibril cellulose, dibenzylidene polyol acetal derivatives, and mixtures thereof;

b. natural abrasive particles selected from the group consisting of nut shell particles, particles derived from other plant sources, and mixtures thereof; and c. a cationic polymer;

wherein said natural abrasive particles are comprised at a level of greater than 2% by weight of the total composition, wherein said composition is substantially opaque and has a viscosity of about 200 to about 8000 centipoises.

2. A composition according to claim 1 wherein said natural abrasive particles are comprised at a level of greater than 2.5% by weight of the total composition.

3. A composition according to claim 1 wherein said natural abrasive particles are coated, coloured, and/or bleached particles.

4. A composition according to claim 1 wherein said particles derived from other plant sources are selected from the group consisting of wood, olive stone, cherry stone, Tagua palm seed endosperm, and mixtures thereof.

5. A composition according to claim 1 wherein said natural abrasive particles consist of nut shell particles.

6. A composition according to claim 1 wherein said nut shell particles are selected from the group consisting of walnut shell particles , almond shell particles, hazelnut shell particles, macadamia nut shell particles, pine nut shell particles and mixtures thereof.

7. A composition according to claim 1 further comprising polymeric particles derived from a polymeric material foam, wherein said polymeric material foam has a density of less than 100 kg/m$^3$.

8. A composition according to claim 7 wherein said polymeric material foam has an open cell structure.

9. A composition according to claim 7 wherein said polymeric material is selected from the group consisting of polyurethane, polyhydroxy alkanoate derivatives (PHA), aliphatic polyesters, polylactic acid derivatives (PLA), polystyrene, melamine-formaldehyde, polyacrylate, polyolefins, polyvinyl, and mixtures thereof.

10. A composition according to claim 7 wherein said polymeric particles consist of polyurethane particles derived from polyurethane foam, wherein said polyurethane foam has a density of less than 100 $kg/m^3$.

11. A composition according to claim 7 wherein said polymeric particles are comprised at a level from 0.1% to 1% by weight of the composition.

12. A composition according to claim 7 wherein the ratio of said natural abrasive particles to said polymeric particles is from 50 to 1.

13. A composition according to claim 1 comprising at least one hydrophobic emollient.

14. A composition according to claim 13 wherein said hydrophobic emollient is selected from the group consisting of hydrocarbon oils and waxes; silicones; fatty acid derivatives; glyceride esters, di and tri-glycerides, acetoglyceride esters; alkyl and alkenyl esters; cholesterol and cholesterol derivatives; vegetable oils, vegetable oil derivatives, liquid nondigestible oils, or blends of liquid digestible or nondigestible oils with solid polyol polyesters; natural waxes; phospholipids; sphingolipids; and mixtures thereof.

15. A composition according to claim 1 wherein the cationic polymer consists of a cationic polysaccharide selected from the group consisting of cationic cellulose derivatives, cationic guar gums derivatives, and mixtures thereof.

16. A composition according to claim 1 wherein said composition further comprises one or more surfactants selected from the group consisting of anionic surfactants, cationic surfactants, non-ionic surfactants, amphoteric surfactants, zwitterionic surfactants, and mixtures thereof.

17. A composition according to claim 16 wherein said one or more surfactants comprises 0.01% to 20% by weight of the composition, of a surfactant selected from the group consisting of an amphoteric surfactant, a zwitterionic surfactant, and mixtures thereof.

18. A composition according to claim 16 wherein said one or more surfactants comprises from 0.1% to 45% by weight of the composition, of a nonionic surfactant selected from the group consisting of $C_8$-$C_{22}$ aliphatic alcohols with 1 to 25 moles of ethylene oxide, alkylpolyglycosides, fatty acid amide surfactants, and mixtures thereof.

19. A process comprising the steps of:

(i) fragmenting a material selected from the group consisting of nut shells, other plant sources, and mixtures thereof, to generate abrasive particles;

(ii) providing one or more suspending aids selected from the group consisting of crystalline wax structurants, amido-gellants, micro fibril cellulose, di-benzylidene polyol acetal derivatives, and mixtures thereof;

(iii) providing a cationic polymer; and (iv) forming a liquid composition by combining the fragmented abrasive particles, the suspending aid, the cationic polymer, and optionally other liquid composition components, wherein said abrasive particles are added at a level of greater than 2% by weight of the composition, wherein said composition is substantially opaque and has a viscosity of about 200 to about 8000 centipoises.

* * * * *